US010875331B2

(12) United States Patent
Mori et al.

(10) Patent No.: US 10,875,331 B2
(45) Date of Patent: Dec. 29, 2020

(54) PRINTER

(71) Applicants: CITIZEN WATCH CO., LTD., Nishitokyo (JP); CITIZEN SYSTEMS JAPAN CO., LTD., Nishitokyo (JP)

(72) Inventors: Yasuyuki Mori, Tokyo (JP); Takehiro Kikui, Tokyo (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/222,308

(22) Filed: Dec. 17, 2018

(65) Prior Publication Data

US 2019/0118566 A1 Apr. 25, 2019

Related U.S. Application Data

(63) Continuation of application No. PCT/JP2017/024270, filed on Jun. 30, 2017.

(30) Foreign Application Priority Data

Jul. 5, 2016 (JP) ..... 2016-133782

(51) Int. Cl.
*B41J 2/325* (2006.01)
*B41J 29/13* (2006.01)
(Continued)

(52) U.S. Cl.
CPC ..... *B41J 29/13* (2013.01); *B41J 2/325* (2013.01); *B41J 17/00* (2013.01); *B41J 33/14* (2013.01)

(58) Field of Classification Search
CPC ... B41J 29/13; B41J 33/14; B41J 2/325; B41J 17/00; B41J 29/026; B41J 29/023; B41J 29/02; B41J 29/00
See application file for complete search history.

(56) References Cited

U.S. PATENT DOCUMENTS

2012/0044309 A1 2/2012 Wanibuchi et al.
2015/0145941 A1 5/2015 Gao et al.

FOREIGN PATENT DOCUMENTS

CN 102371782 A 3/2012
JP 62-73979 A 4/1987
(Continued)

OTHER PUBLICATIONS

International Preliminary Report on Patentability issued for corresponding International Patent Application No. PCT/JP2017/024270, dated Jan. 8, 2019, and notification of transmittal of the English translation dated Jan. 17, 2019.
(Continued)

*Primary Examiner* — Kristal Feggins
(74) *Attorney, Agent, or Firm* — Myers Wolin, LLC

(57) ABSTRACT

An inner ribbon mounting opening is provided at a lower side of a cover member (202) that is rotatably connected with a housing (201), the cover member (202) housing a ribbon unit that holds an ink ribbon (302) held so as to be freely fed and freely taken up. An outer ribbon mounting opening (301) is further provided at an upper side. Thus, work can be performed from both directions above and below the cover member (202). As a result, work can be performed selectively using the outer ribbon mounting opening (301) or the inner ribbon mounting opening, and the workability for mounting and removing the ink ribbon can be enhanced.

8 Claims, 16 Drawing Sheets

(51) Int. Cl.
*B41J 17/00* (2006.01)
*B41J 33/14* (2006.01)

(56) References Cited

FOREIGN PATENT DOCUMENTS

| | | | |
|---|---|---|---|
| JP | 11-291584 | A | 10/1999 |
| JP | 2003-191557 | A | 7/2003 |
| JP | 2009-119827 | A | 6/2009 |
| JP | 2009-179010 | A | 8/2009 |
| JP | 2009-286002 | A | 12/2009 |
| JP | 2013-32016 | A | 2/2013 |
| JP | 2013-147036 | A | 8/2013 |
| JP | 2015-96336 | A | 5/2015 |

OTHER PUBLICATIONS

International Search Report issued by the Japan Patent Office for corresponding International Patent Application No. PCT/JP2017/024270, dated Sep. 19, 2017, with an English translation.
First Notification of Office Action issued by the China National Intellectual Property Administration for corresponding Chinese Patent Application No. 201780040838.5, dated Mar. 11, 2020, with an English machine translation.

PRINTER

CROSS-REFERENCE TO RELATED APPLICATIONS

This application is a continuation application of International Application PCT/JP2017/024270 filed on Jun. 30, 2017 and claims priority to Japanese Patent Application No. 2016/133782, filed Jul. 5, 2016, the entire contents of each are incorporated herein by reference.

TECHNICAL FIELD

The present invention relates to a printer that performs a recording operation using an ink ribbon.

BACKGROUND ART

Up to now, printers have been present that perform a recording operation by using an ink ribbon and transferring ink of the ink ribbon to a recording medium. According to one technique, in such a printer, a ribbon unit holds the ink ribbon and is housed inside a cover member that can be opened and closed, the ribbon unit being provided to be swingable with respect to a printer body and a cover of a case that houses the printer body, and at the time of replacement work for the ink ribbon, the ribbon unit is swung and separated from the cover member, whereby space for the work is established in a vicinity of the ribbon unit (for example, refer to Patent Documents 1 to 5 below).

Patent Document 1: Japanese Laid-Open Patent Publication No. 2009-179010

Patent Document 2: Japanese Laid-Open Patent Publication No. 2009-286002

Patent Document 3: Japanese Laid-Open Patent Publication No. 2013-032016

Patent Document 4: Japanese Laid-Open Patent Publication No. 2013-147036

Patent Document 5: Japanese Laid-Open Patent Publication No. 2015-096336

DISCLOSURE OF INVENTION

Problem to be Solved by the Invention

Nonetheless, with conventional techniques described in the patent documents above, even in a state in which the ribbon unit is swung and space for the work has been established in a vicinity of the ribbon unit, a problem arises in that work can be performed from only one direction with respect to the ribbon unit and workability is unfavorable. In particular, the conventional techniques described in the patent documents above have a problem in that the work has to be performed in a posture such that worker looks in at the ink ribbon from below, placing a large load on the worker and causing the worker to become fatigued.

Further, the conventional techniques described in the patent documents above have a problem in that a configuration to swing the ribbon unit is complicated. Moreover, the conventional techniques described in the patent documents above have a problem in that since the configuration is complicated, the number of components configuring the printer is large. A further problem arises in that due to the complicated configuration and the large number of components, the frequency of breakdown of the printer is high as compared to a case of a simple configuration and few components.

To solve the problems of the conventional techniques above, one object of the present invention is to provide a printer that can facilitate enhancement of the workability for ink ribbon.

Means for Solving Problem

To solve the problems above and achieve an object, a printer according to the present invention is characterized in that the printer includes a housing that has a substantially box-shape and includes a first opening that opens facing in one direction; a platen provided in the housing; a cover that has a substantially box-shape and includes a second opening that opens facing in another direction opposite that of the first opening, the cover rotatably connected with the housing via a connection member and with the connection member as a center, the cover rotating to be positioned at a closed position making the second opening oppose the first opening and the cover rotating to be positioned at an open position making the second opening open; a print head that is provided in the cover and opposes the platen in a state in which the cover is positioned at the closed position; and a pair of shaft members in the cover, closer to the second opening than the print head, the pair of shaft members provided enabling rotation thereof around an axis parallel a main scanning direction, the pair of shaft members holding an ink ribbon that is positioned between the platen and the print head in a state where the cover is positioned at the closed position, the ink ribbon being held so as to be freely fed and freely taken up. The cover includes a third opening that at a side opposite that of the second opening, opens the print head and the pair of shaft members to an outside.

The printer according to the present invention is further characterized in that the pair of shaft members, in a plan view, overlaps the second opening and the third opening.

The printer according to the present invention is further characterized in that the printer further includes a conveyance guide member that guides a recording medium is provided enabling rotation of the conveyance guide member between a ribbon guide position whereby the ink ribbon is covered from a side toward the second opening and a ribbon open position whereby the ink ribbon is open to the outside through the second opening.

The printer according to the present invention is further characterized in that the printer further includes a holding unit that holds the recording medium enabling an end of the recording medium to be pulled out from an outer circumferential side of the recording medium that has an elongated shape and is wound in a roll; and a damper member that is configured by a contact member that is provided to the conveyance guide member and displaceable along a direction away from a conveyance path that conveys between the platen and the print head, the recording medium held by the holding unit, the damper member further configured by a biasing member that biases the contact member toward the conveyance path.

The printer according to the present invention is further characterized in that the conveyance guide member is positioned between the ink ribbon and the recording medium in the conveyance path.

The printer according to the present invention is further characterized in that the third opening has along the main scanning direction, a dimension that is larger than a dimension of the pair of shaft members, along the main scanning direction.

The printer according to the present invention is further characterized in that the third opening is provided in the cover, spanning two continuous faces.

The printer according to the present invention is further characterized in that the printer further includes a guide member from the third opening to a support unit that supports each shaft member of the pair of shaft members.

The printer according to the present invention is further characterized in that the guide member has a shape that expands more on a side toward the third opening than on a side toward the support unit.

Effect of the Invention

The printer according to the present invention achieves an effect in that enhancement of the workability for mounting and removing the ink ribbon can be facilitated.

BEST MODE(S) FOR CARRYING OUT THE INVENTION

Preferred embodiments of a printer according to the present invention will be described in detail with reference to the accompanying drawings.

First Embodiment (Configuration of Printer)

Figure 1:
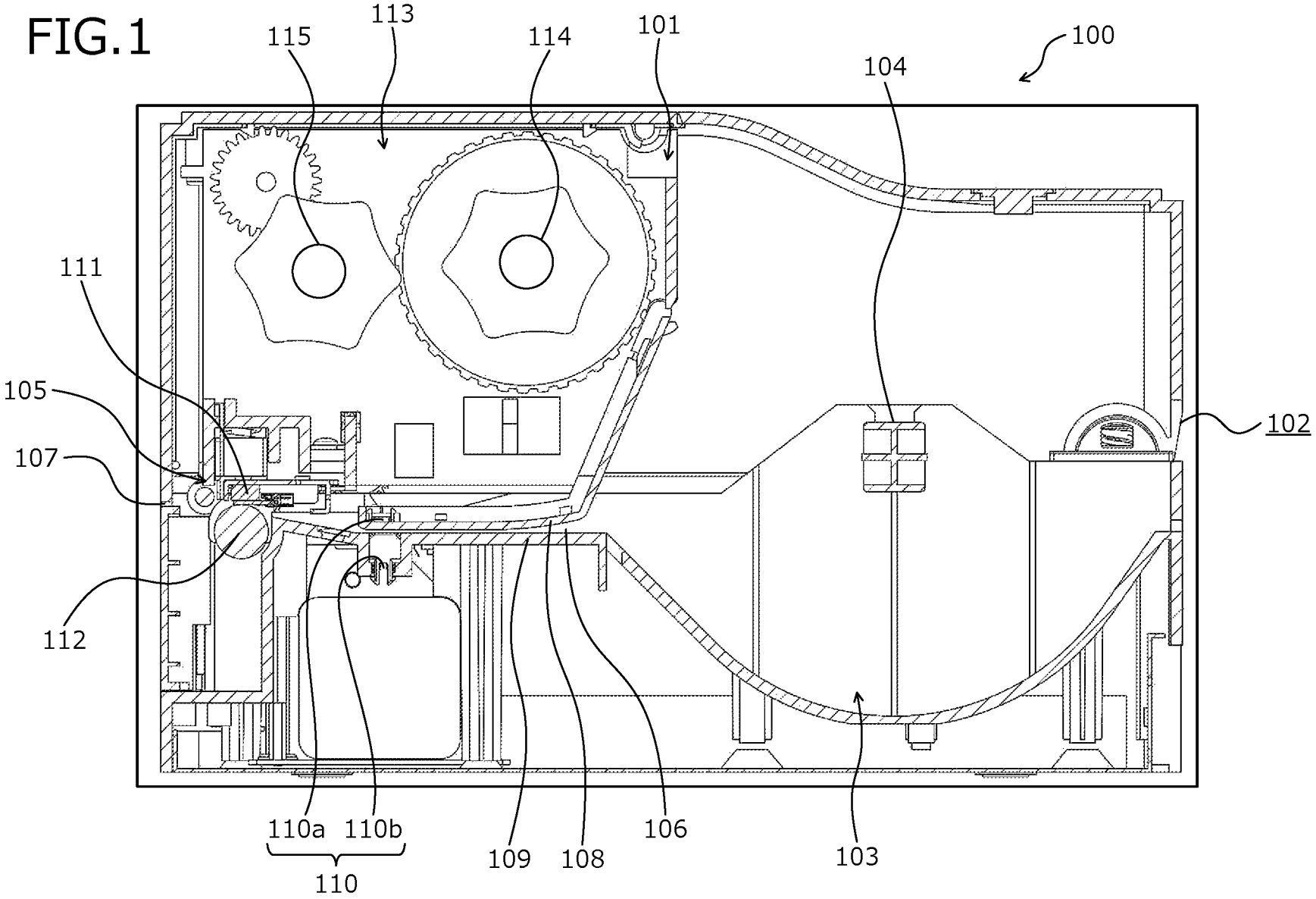
FIG. 1 is an explanatory drawing depicting a configuration of a printer of a first embodiment according to the present invention.

First, a configuration of the printer of the first embodiment according to the present invention will be described. FIG. 1 is an explanatory drawing depicting the configuration of the printer of the first embodiment according to the present invention. FIG. 1 depicts a cross-section of the printer of the first embodiment according to the present invention, cut along a sub-scanning direction.

In FIG. 1, a printer 100 includes a printer body 101 and a case 102 that houses the printer body 101. The printer body 101 includes a recording medium holding unit 103 that holds a recording medium wound in a roll. The recording medium holding unit 103 includes a paper shaft 104 that is inserted in a cylindrical space (core) formed at an inner circumferential side of the recording medium wound in a roll.

Figure 7:
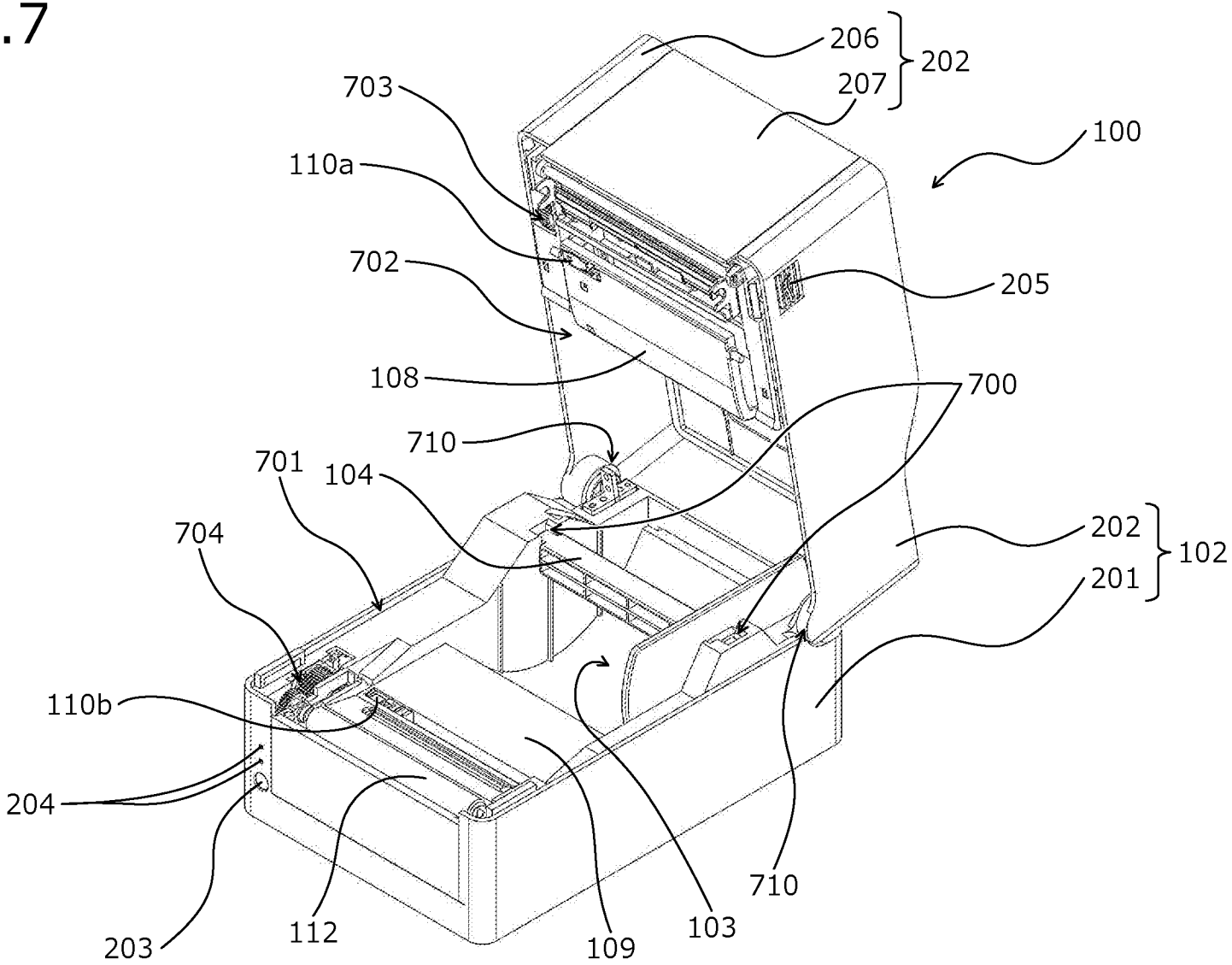
FIG. 7 is an explanatory drawing depicting a state in which a cover member of the printer depicted in FIG. 2 is positioned at an open position.

The recording medium holding unit 103 supports both ends of the paper shaft 104 that is inserted in the core of the elongated recording medium wound in a roll (refer to FIG. 7). In particular, the paper shaft 104 is supported by a housing (refer to reference numeral 201 in FIG. 2) while inserted in the core of the recording medium wound in a roll. The paper shaft 104, without being fixed to the core of the recording medium wound in a roll, spins idly with respect to the rotation of the core and thereby, supports the recording medium enabling the recording medium to rotate around an axis. As a result, the recording medium can be pulled out from an end on an outer circumferential side.

The paper shaft 104 is provided enabling mounting and removal with respect to the housing and, for example, during replacement of the recording medium, is removed and mounted with respect to the housing. In the first embodiment, a holding unit according to the present invention can be realized by the recording medium holding unit 103.

The printer body 101 includes a recording medium conveyance path 106 that guides the recording medium held by the recording medium holding unit 103, the recording medium being guided toward a paper outlet 107, through a recording unit 105. The recording medium conveyance path 106 is formed between the recording medium holding unit 103 and the paper outlet 107. In the first embodiment, a conveyance path of the present invention can be realized by the recording medium conveyance path 106.

At an upper side of the recording medium conveyance path 106, an upper paper guide 108 is provided. The upper paper guide 108, from an upper side of the recording medium, guides a position of the recording medium conveyed along the recording medium conveyance path 106 from the recording medium holding unit 103. In the first embodiment, a conveyance guide member according to the present invention can be realized by the upper paper guide 108.

At a lower side of the recording medium conveyance path 106, a lower paper guide 109 is provided. The lower paper guide 109, from a lower side (lower side in a vertical direction) of the recording medium, guides the position of the recording medium conveyed along the recording medium conveyance path 106 from the recording medium holding unit 103 and supports the recording medium from the lower side.

On the recording medium conveyance path 106, a sensor 110 is provided that detects a presence or absence of the recording medium conveyed in the recording medium conveyance path 106. The sensor 110, for example, can be realized by a photoelectric sensor that detects the presence or absence of the recording medium by the presence or absence of light received at a light receiving unit to which a light projecting unit projects light.

The sensor (photoelectric sensor) 110 is provided so that an optical path formed between a light receiving unit 110*a* and a light projecting unit 110*b* intersects the recording medium conveyance path 106. In the printer 100 of the first embodiment, the light projecting unit 110*b* is provided at the upper paper guide 108 and the light receiving unit 110*a* is provided at the lower paper guide 109, the light projecting unit 110*b* and the light receiving unit 110*a* opposing each other across the recording medium conveyance path 106.

The recording unit 105 performs a recording operation of recording text or the like on the recording medium pulled out from the recording medium holding unit 103 into the recording medium conveyance path 106. Without limitation to recording text, the recording unit 105 can record other than text, for example, symbols, predetermined logo marks, other images, and the like.

The recording unit 105 includes a print head 111 and a platen 112. The print head 111, for example, can use a thermal head that performs recording by a thermal method. The thermal head includes plural heating elements (heating resistors) arrayed in a line along a main scanning direction (width direction of the recording medium).

Further, the thermal head includes a driver IC that drives the heating resistors. The driver IC, from a power source, selectively electrifies electrode wires that correspond to the heating elements in the thermal head and thereby, heats the heating elements that correspond to the electrified electrode wires. The thermal head can record text, symbols, various types of images, and the like to the recording medium by transmitting the heat generated at the heating elements to the ink ribbon, thereby melting and transferring the ink to recording medium.

The platen 112 has a cylindrical shape and is provided enabling rotation around an axis parallel to the main scanning direction. The print head 111 opposes an outer peripheral surface of the platen 112, across the recording medium conveyance path 106. The outer peripheral surface of the platen 112 opposes the thermal head over an entire area along the main scanning direction. The platen 112 supports the recording medium conveyed in the recording medium conveyance path 106, the platen 112 supporting the recording medium across the recording medium conveyance path 106, from a side (lower side) of the recording medium opposite that facing toward the print head 111. The platen 112 is connected to a driving source such as a platen motor, via a predetermined gear train (refer to reference numeral 704 in FIG. 7) or the like, whereby the platen 112 is subject to a driving force transmitted from the platen motor and rotates.

Figure 3:
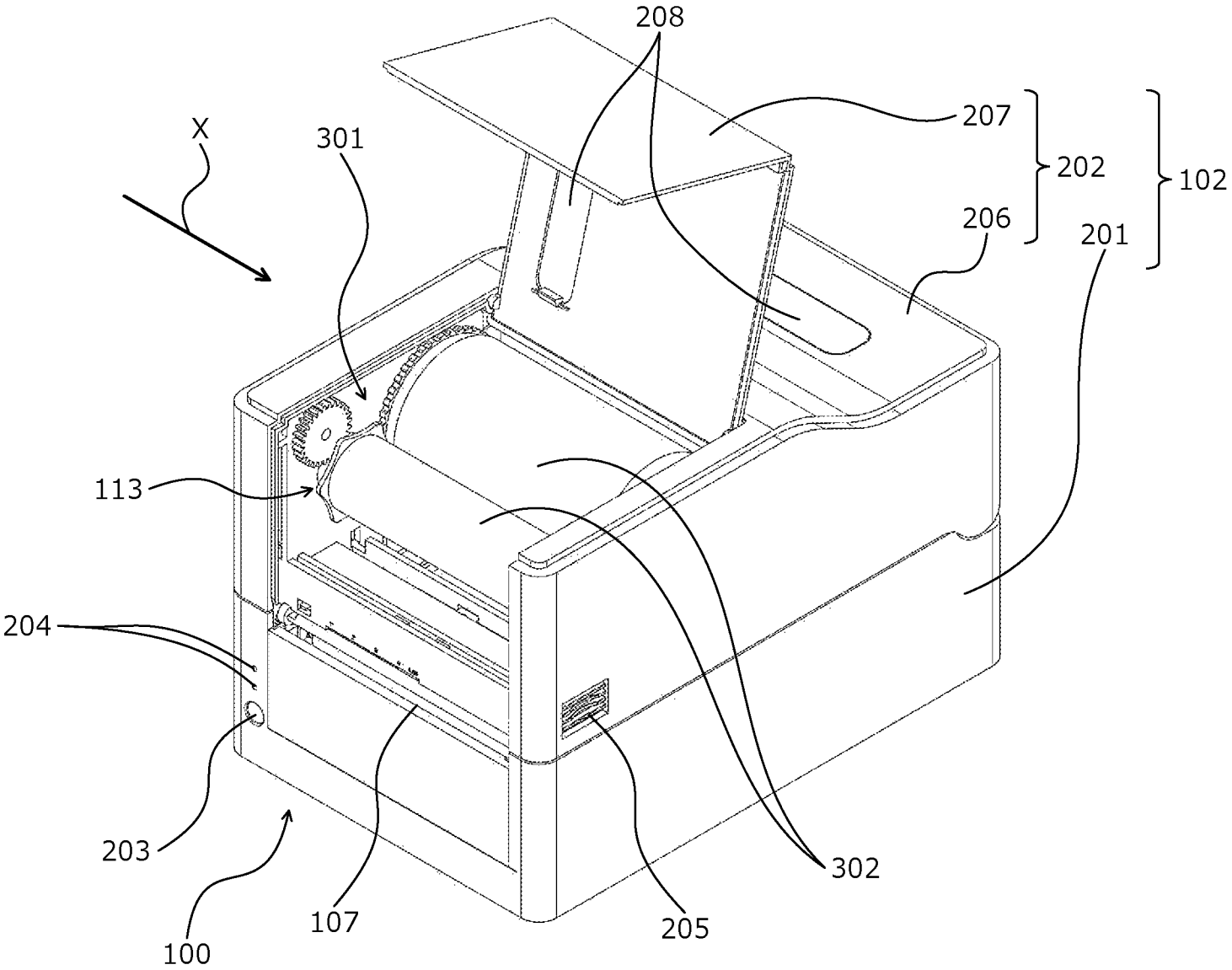
FIG. 3 is an explanatory drawing depicting a state in which a top cover of the printer depicted in FIG. 2 is positioned at an open position.
Figure 4:
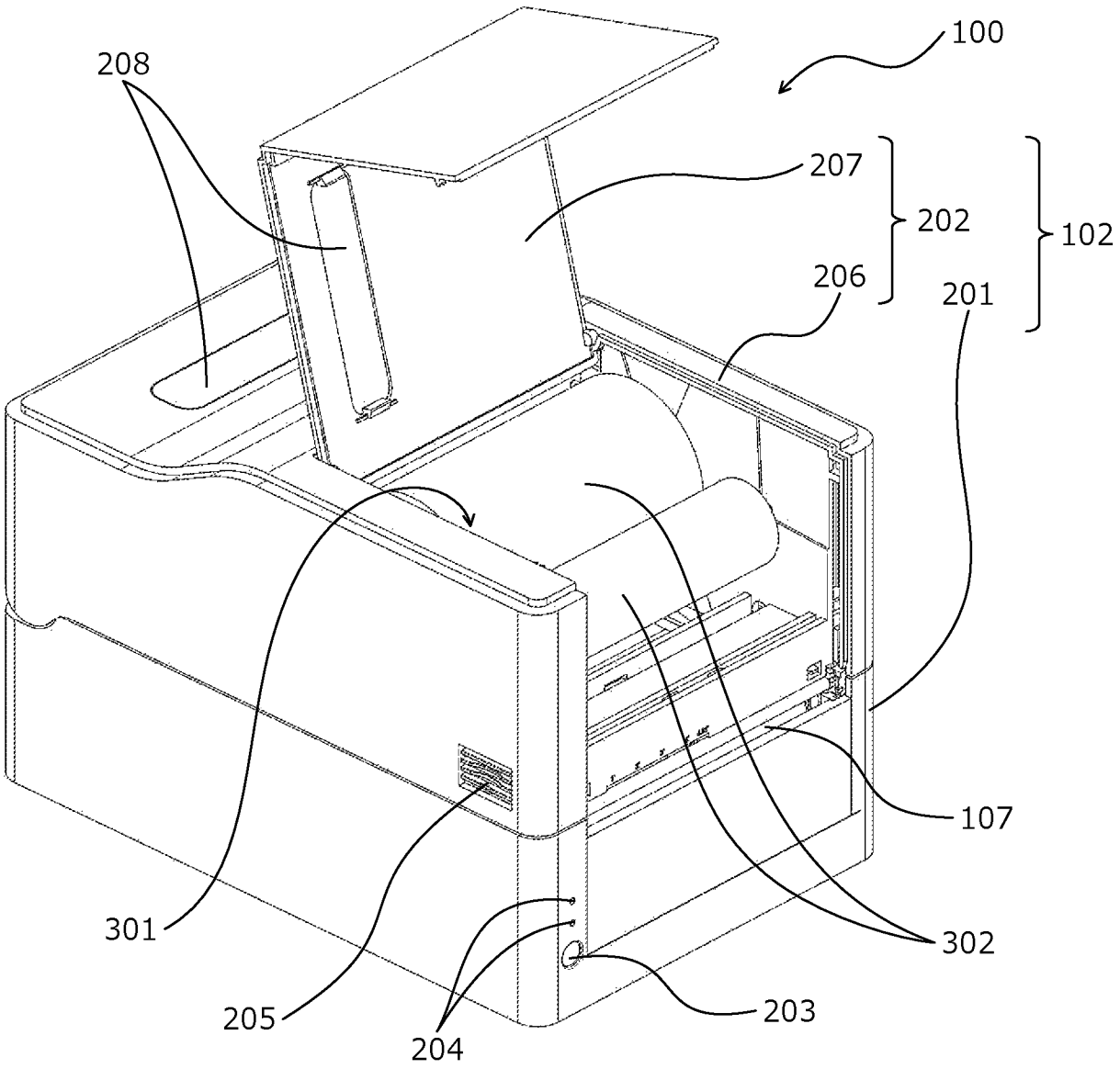
FIG. 4 is an explanatory drawing depicting a state of the printer 100 depicted in FIG. 3, as viewed along a direction indicated by arrow X.

The recording unit 105 includes a ribbon unit 113 that supports an ink ribbon (refer to reference numeral 302 in FIGS. 3 and 4). The ribbon unit 113 includes a ribbon support axle 114 that supports the ink ribbon prior to the ink ribbon being provided for the recording operation and a ribbon take-up axle 115 that winds the ink ribbon after the recording operation. The ribbon support axle 114 and the ribbon take-up axle 115 are provided enabling rotation around an axis parallel to the main scanning direction.

The ink ribbon is passed between the ribbon support axle 114 and the ribbon take-up axle 115, passing a surface of the print head 111, the surface facing toward the platen 112. The recording unit 105 performs the recording operation of melting and transferring to the recording medium, a part of the ink ribbon, the part corresponding to heated heating elements.

Further, the ribbon unit 113 includes a ribbon-axle drive mechanism that rotates the ribbon take-up axle 115. The ribbon-axle drive mechanism is constituted by a ribbon take-up motor, a gear train (refer to reference numeral 703 in FIG. 7) that transmits a driving force of the ribbon take-up motor to the ribbon take-up axle 115, a ribbon board that drives the ribbon take-up motor, and the like.

The ribbon unit 113, according to the recording medium conveyed by the platen 112, uses the ribbon-axle drive mechanism to feed the ink ribbon supported by the ribbon support axle 114, and winds the fed ink ribbon at the ribbon take-up axle 115. In the first embodiment, a pair of shaft members according to the present invention can be realized by the ribbon support axle 114 and the ribbon take-up axle 115.

The upper paper guide 108 is positioned between the recording medium and the ink ribbon passed between the ribbon support axle 114 and the ribbon take-up axle 115, and covers the ink ribbon at a side closer to the recording medium holding unit 103 than a recording position by the print head 111. As a result, contact of the ink ribbon and the recording medium can be prevented, and irrespective of an outer diameter (remaining amount) of the recording medium held by the recording medium holding unit 103, unintended marks on the recording medium due to the recording medium contacting the ink ribbon can be prevented.

(Exterior of Printer 100)

Figure 2:
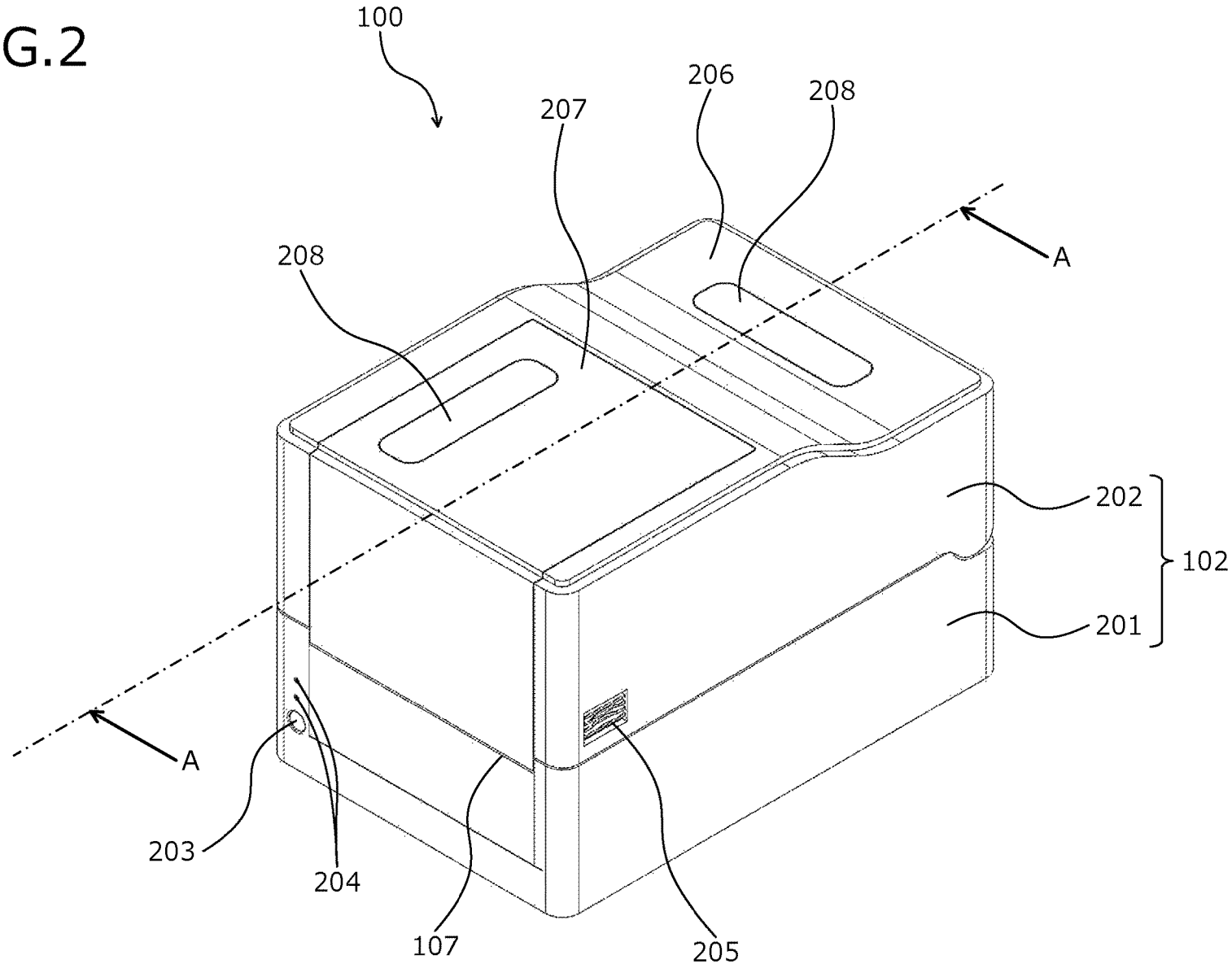
FIG. 2 is an explanatory drawing depicting an exterior of the printer of the first embodiment according to the present invention.

The exterior of the printer 100 of the first embodiment according to the present invention will be described. FIG. 2 is an explanatory drawing depicting the exterior of the printer 100 of the first embodiment according to the present invention. FIG. 2 depicts the exterior of the printer 100 in state during use. In FIG. 1 described above, a cross-section of the printer 100 of the first embodiment according to the present invention cut along line A-A in FIG. 2 is depicted.

In FIG. 2, the case 102 is configured by a housing 201 and a cover member 202. In the first embodiment, the cover member 202 realizes a cover according to the present invention. The housing 201 has a box-shape having a housing opening (refer to reference numeral 701 in FIG. 7) that opens facing in one direction. On the housing 201, on a front side of the case 102, a paper conveyance switch 203 and a lamp 204 are provided. The lamp 204 reports states of the printer 100 and the like by a presence or absence light, lighting patterns, or lit colors.

The cover member 202 has a box-shape having an inner ribbon mounting opening (refer to reference numeral 702 in FIG. 7) that opens facing in another direction opposite that of a first opening. The cover member 202, at a rear side of the printer 100, is connected with the housing 201, via a hinge (refer to reference numeral 710 in FIG. 7), enabling rotation of the cover member 202 with respect to the housing 201. The cover member 202 rotates relatively between a closed position whereby the inner ribbon mounting opening opposes the first opening, and an open position whereby the inner ribbon mounting is open.

The case 102 includes a lock mechanism that locks the position of the cover member 202 at the closed position with respect to the housing 201. The cover member 202 positioned at the closed position can be moved to the open position by manipulating an operation part 205 provided on the cover member 202 and releasing a lock.

The printer 100, at the time of use, is installed in a state in which the first opening provided in the housing 201 is facing upward, i.e., a state in which the housing 201 is positioned lower than the cover member 202. The paper outlet 107 is formed at a front of the case 102, between the housing 201 and the cover member 202 in a state where the cover member 202 is positioned at the closed position.

Further, the cover member 202 is configured by a cover member body 206 and a top cover 207. The top cover 207 closes and enables opening of an outer ribbon mounting opening (refer to reference numeral 301 in FIG. 3) provided at the cover member 202, on a side opposite that of the inner ribbon mounting opening. The top cover 207 is connected with the cover member body 206, enabling rotation of the top cover 207 with respect to the cover member body 206, the top cover 207 rotating between a closed position whereby the outer ribbon mounting opening is closed and an open position whereby the outer ribbon mounting opening is open. In the cover member body 206 and the top cover 207, a window 208 is provided and through the window 208, an interior of the case 102 can be visually checked.

(Internal Configuration of Cover Member Body 206)

An internal configuration of the cover member body 206 will be described. FIG. 3 is an explanatory drawing depicting a state in which the top cover 207 of the printer 100 depicted in FIG. 2 is positioned at the open position. FIG. 4 is an explanatory drawing depicting a state of the printer 100 depicted in FIG. 3, as viewed along a direction indicated by arrow X.

In FIGS. 3 and 4, the outer ribbon mounting opening 301 is opened by positioning the top cover 207 at the open position. In a state where the cover member 202 is positioned at the open position and the top cover 207 is positioned at the open position, the ink ribbon 302 wound around the ribbon support axle 114 and the ribbon take-up axle 115 can be seen entirely from above the cover member 202.

Further, the outer ribbon mounting opening 301 is provided in the cover member 202, spanning two continuous faces. In particular, the outer ribbon mounting opening 301 is provided so to be open, spanning a top surface and a front surface of the cover member 202. As a result, in a state where the top cover 207 is positioned at the open position, the inside of the cover member 202 can be visually checked over a wide range from the top and the front side.

The outer ribbon mounting opening 301 may be formed to have a dimension along the main scanning direction that is greater than dimensions of the ribbon support axle 114 and the ribbon take-up axle 115, along the main scanning directions thereof. With such a configuration, in a state where the cover member 207 is positioned at the open position, the ink ribbon 302 wound around the ribbon support axle 114 and the ribbon take-up axle 115 can be visually checked overall from above the cover member.

Further, the outer ribbon mounting opening 301 opposes the inner ribbon mounting opening, with the ribbon support axle 114 and the ribbon take-up axle 115 being between the outer ribbon mounting opening 301 and the inner ribbon mounting opening. In the first embodiment, a third opening according to the present invention can be realized by the outer ribbon mounting opening 301.

In a plan view, the outer ribbon mounting opening 301, the inner ribbon mounting opening, the ribbon support axle 114, and the ribbon take-up axle 115 overlap each other. In other words, both ends of the ribbon support axle 114 and of the ribbon take-up axle 115 are positioned in a space that is open due to the inner ribbon mounting opening and the outer ribbon mounting opening 301.

As a result, in a state where the top cover 207 is positioned at the open position and the cover member 202 is positioned at the open position, work for the ink ribbon 302 passed between the ribbon support axle 114 and the ribbon take-up axle 115 can be performed from both the outer ribbon mounting opening 301 side and the inner ribbon mounting opening side.

Figure 5:
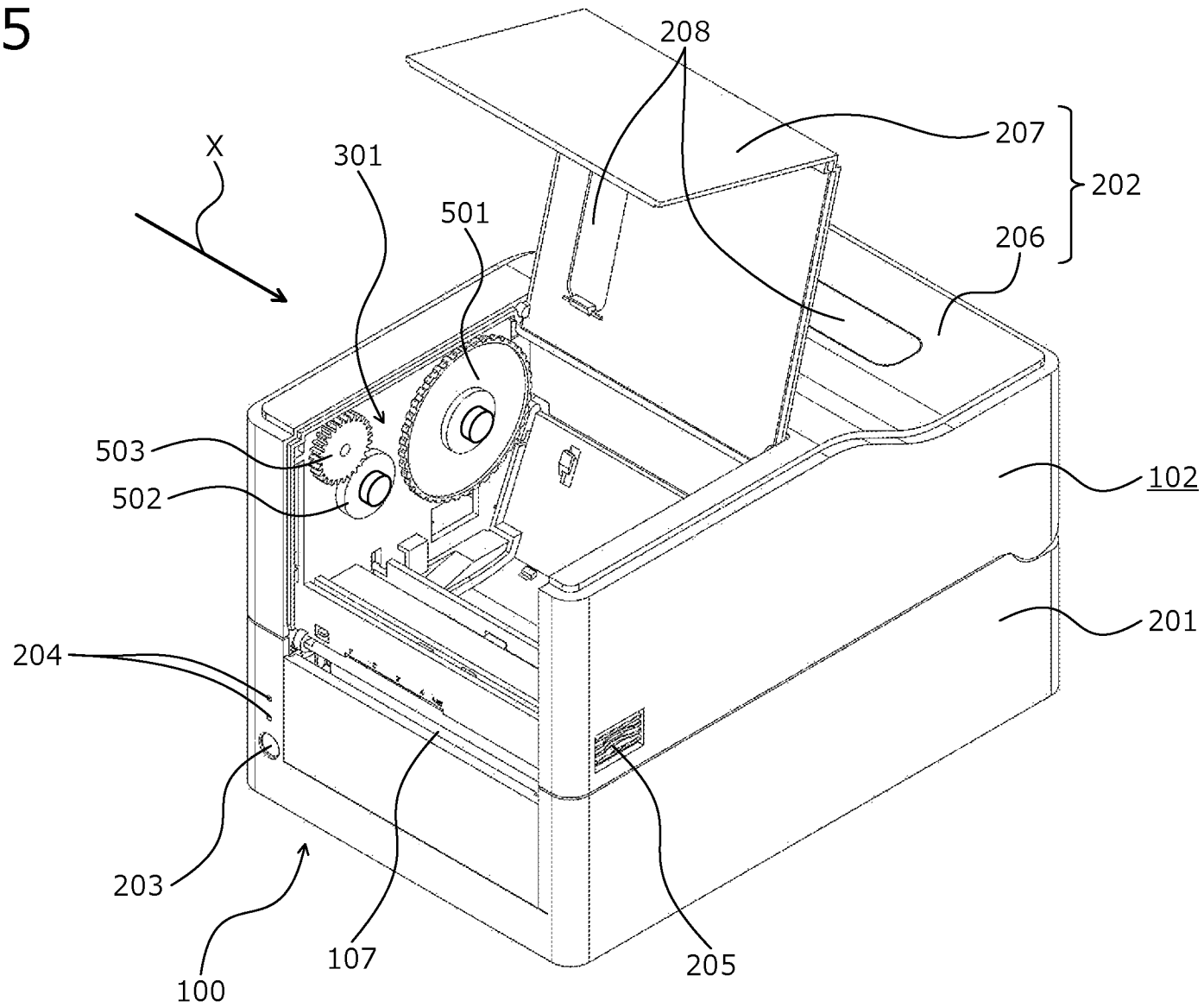
FIG. 5 is an explanatory drawing depicting a state in which a ribbon support axle and a ribbon take-up axle have been removed from the printer depicted in FIG. 3.
Figure 6:
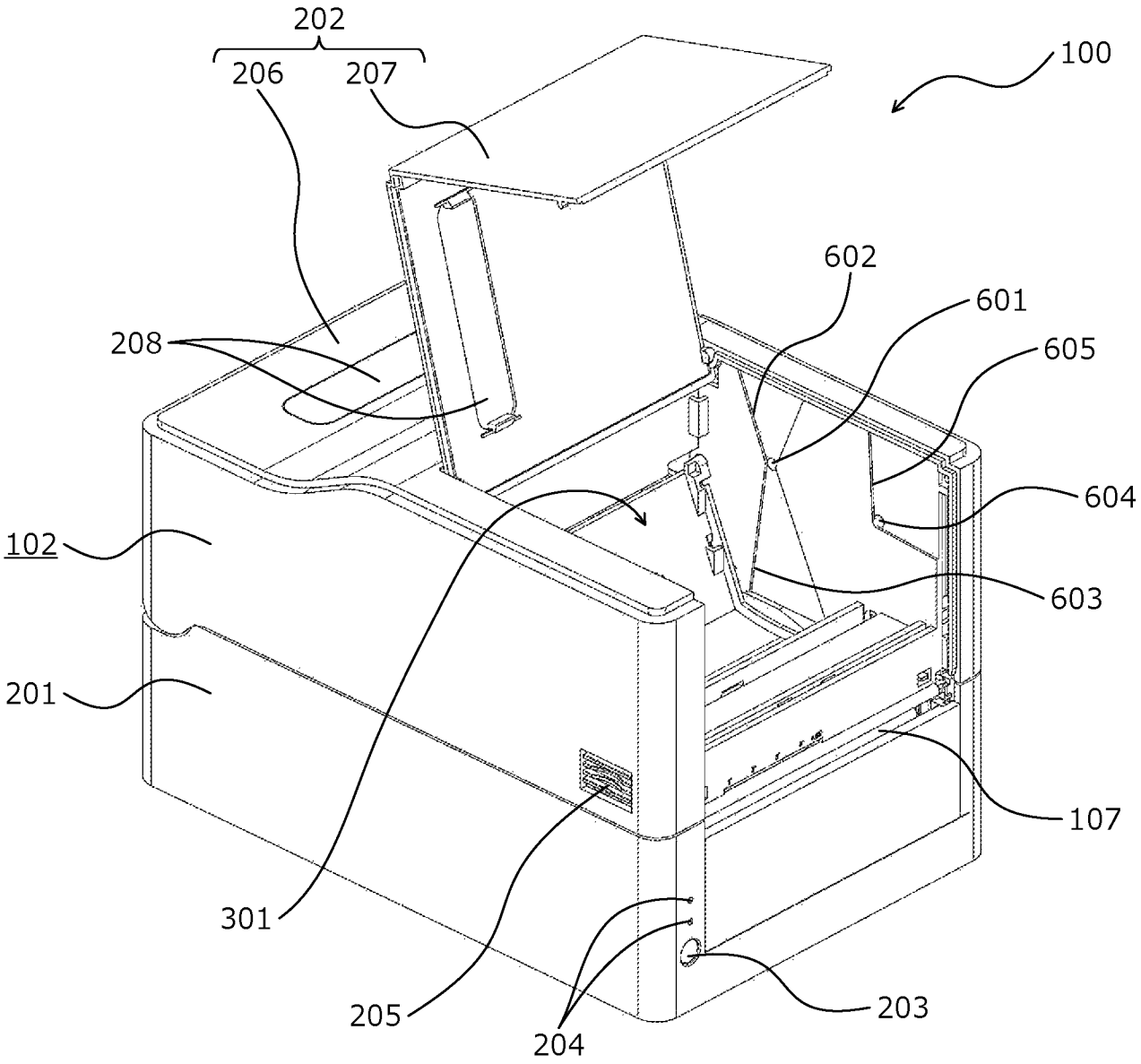
FIG. 6 is an explanatory drawing depicting a state of the printer depicted in FIG. 5, as viewed along a direction indicated by arrow X.

FIG. 5 is an explanatory drawing depicting a state in which the ribbon support axle 114 and the ribbon take-up axle 115 have been removed from the printer 100 depicted in FIG. 3. FIG. 6 is an explanatory drawing depicting a state of the printer 100 depicted in FIG. 5, as viewed along a direction indicated by arrow X. In FIGS. 5 and 6, a first support mechanism that supports the ribbon support axle 114 is provided in the ribbon unit 113.

The first support mechanism supports, in a rotatable manner, both axial ends of the ribbon support axle 114, the axial ends in an axial direction. In particular, the first support mechanism is configured by a first gear 501 that is provided enabling rotation of the first gear 501 with respect to the cover member 202, the first gear 501 engaging with one of the axial ends of the ribbon support axle 114, and the first support mechanism further configured by a first support hole 601 that engages with the other axial end of the ribbon support axle 114.

At a surface that is an inner wall surface of the cover member 202, the surface being on a side of the other axial end of the ribbon support axle 114 in the axial direction, a first upper guide member 602 is provided from the outer ribbon mounting opening 301 to the first support hole 601. At the surface that is the inner wall surface of the cover member 202 and that is on the side of the other axial end of the ribbon support axle 114 in the axial direction, the first upper guide member 602 has a concave shape that is more concave toward the outside of the cover member 202 than is the surrounding surface.

When the ribbon support axle 114 is to be mounted in the first support hole 601, the ribbon support axle 114 is positioned within a range of the first upper guide member 602 and then, the ribbon support axle 114 is pushed downward and lowered along the first upper guide member 602. The first upper guide member 602 guides the position of the ribbon support axle 114 that is pushed downward and lowered, the first upper guide member 602 guiding the position toward the first support hole 601 by a stepped part between the first upper guide member 602 having a concave shape and the surface that is the inner wall surface of the cover member 202 and on the side of the other axial end of the ribbon support axle 114 in the axial direction.

Provision of the first upper guide member 602 enables the ribbon support axle 114 to be assuredly mounted in the first support hole 601 by a simple operation of merely pushing downward and lowering the ribbon support axle 114. When the ribbon support axle 114 is to be removed from the first support hole 601, the ribbon support axle 114 can be assuredly removed from the first support hole 601 by a simple operation of merely lifting the ribbon support axle 114 toward the outer ribbon mounting opening 301.

Further, the first upper guide member 602 has a shape that expands more on the outer ribbon mounting opening 301 side than on the first support hole 601 side. More specifically, the first upper guide member 602 has a shape in which the upper side expands more than the side toward the first support hole 601. When the ribbon support axle 114 is to be mounted in the first support hole 601, first, in a vicinity of the outer ribbon mounting opening 301 that facilitates the work, the ribbon support axle 114 is positioned within a range of a concave part formed by the first upper guide member 602 and then, the ribbon support axle 114 is pushed downward and lowered along the first upper guide member 602. As a result, the ribbon support axle 114 can be assuredly mounted in the first support hole 601 by a simple operation without performing the work of fine alignment.

Further, at the surface that is the inner wall surface of the cover member 202 and on the side of the other axial end of the ribbon support axle 114 in the axial direction, a first lower guide member 603 from the inner ribbon mounting opening to the first support hole 601 is provided. At the surface that is the inner wall surface of the cover member 202 and on the side of the other axial end of the ribbon support axle 114 in the axial direction, the first lower guide member 603 has a concave shape that is more concave toward the outside of the cover member 202 than is the surrounding surface. Further, the first lower guide member 603 has a shape that expands more on a second opening side than on the first support hole 601 side.

As a result, from a lower side of the cover member 202, the ribbon support axle 114 can be mounted or removed through the inner ribbon mounting opening. In this instance as well, similarly to performing the work through the outer ribbon mounting opening 301, first, at a vicinity of the inner ribbon mounting opening facilitating the work, the ribbon support axle 114 is positioned within a range of a concave part formed by the first lower guide member 603 and then, the ribbon support axle 114 is pushed upward and lifted along the first lower guide member 603.

As a result, the ribbon support axle 114 can be assuredly mounted in the first support hole 601 by a simple operation without performing the work of fine alignment. Further, the ribbon support axle 114 can be assuredly removed from the first support hole 601 by a simple operation of merely pulling out the ribbon support axle 114 toward the inner ribbon mounting opening.

Further, a second support mechanism that supports the ribbon take-up axle 115 is provided in the ribbon unit 113. The second support mechanism supports, in a rotatable manner, both axial ends of the ribbon take-up axle 115, the axial ends in the axial direction. In particular, the second support mechanism is configured by a second gear 502 that is provided enabling rotation of the second gear 502 with respect to the cover member 202, the second gear 502 engaging with one of the axial ends of the ribbon take-up axle 115, and the second support mechanism further configured by a second support hole 604 that engages with the other axial end of the ribbon take-up axle 115 in the axial direction.

The second gear 502 is interlinked with a third gear 503. The third gear 503 is connected to the ribbon take-up motor. The second gear 502 and the third gear 503 configure a gear train that transmits the driving force of the ribbon take-up motor to the ribbon take-up axle 115. By the ribbon take-up axle 115 being rotated, the ribbon support axle 114 rotates pulled by the ink ribbon 302 that is wound around the ribbon take-up axle 115.

At the surface that is the inner wall surface of the cover member 202 and that is on a side of the other axial end of the ribbon take-up axle 115, a second upper guide member 605 is provided from the outer ribbon mounting opening 301 to the second support hole 604. At the surface that is the inner wall surface of the cover member 202 and that is on the side of the other axial end of the ribbon take-up axle 115 in the axial direction, the second upper guide member 605 has a concave shape that is more concave toward the outside of the cover member 202 than is the surrounding surface. Further, the second upper guide member 605 has a shape that expands more on the outer ribbon mounting opening 301 side than on the support hole side. More specifically, the second upper guide member 605 has a shape in which the upper side and the front side expand more than the second support hole 604 side.

When the ribbon take-up axle 115 is to be mounted in the second support hole 604, first, in a vicinity of the outer ribbon mounting opening 301 that facilitates the work, the ribbon take-up axle 115 is positioned within a range of a concave part formed by the second upper guide member 605 and then, the ribbon take-up axle 115 is pushed downward and lowered along the second upper guide member 605.

The second upper guide member 605 guides the position of the ribbon take-up axle 115 that is pushed downward and lowered toward the second support hole 604, the second upper guide member 605 guiding the position of the ribbon take-up axle 115 by a stepped part between the second upper guide member 605 having the concave shape and the surface that is the inner wall surface of the cover member 202 and that is on the side of the other axial end of the ribbon take-up axle 115 in the axial direction. As a result, the ribbon take-up axle 115 can be assuredly mounted in the second support hole 604 without performing the work of fine alignment.

In the first embodiment, a support unit according to the present invention can be realized by the first support hole 601 and the second support hole 604. Further, in the first embodiment, a guide member according to the present invention can be realized by the first upper guide member 602 and the second upper guide member 605.

A dimension of the outer ribbon mounting opening 301 along the main scanning direction is larger than dimensions of the ribbon support axle 114 and the ribbon take-up axle 115 along the main scanning direction and therefore, in a state with the cover member 202 positioned at the closed position and the top cover 207 positioned at the open position, thereby opening the outer ribbon mounting opening 301, the ribbon support axle 114 and/or the ribbon take-up axle 115 can be visually checked from above the printer 100, and work for the ribbon support axle 114 and/or the ribbon take-up axle 115 can be performed from the top of the printer 100. Further, the outer ribbon mounting opening 301 opens toward the front and the top and therefore, sufficient work space can be established, enabling work for the ribbon support axle 114 and the ribbon take-up axle 115 to be performed easily and assuredly.

FIG. 7 is an explanatory drawing depicting a state in which the cover member 202 of the printer 100 depicted in FIG. 2 is positioned at the open position. In FIG. 7, the recording medium holding unit 103 is open to the outside through the housing opening 701, by rotating the cover member 202 with respect to the housing 201 and positioning the cover member 202 at the open position. The cover member 202 is connected with the housing 201, via the hinge 710. In the first embodiment, the first opening according to the present invention can be realized by the housing opening 701.

The paper shaft 104 can be mounted to or removed from the housing 201 in a state with the cover member 202 positioned at the open position. The recording medium holding unit 103 includes a pair of support units 700 supporting both ends of the paper shaft 104. The pair of support units 700 is provided in the housing 201.

Each of the pair of support units 700 receives insertion of the ends of the paper shaft 104 from above, through the housing opening 701. As a result, in a state with the cover member 202 positioned at the open position, the recording medium can be mounted in the recording medium holding unit 103 by a simple operation of merely fitting both ends of the paper shaft 104 that is inserted in the core of the recording medium, into the pair of support units 700 from above.

The lower paper guide 109 and the platen 112 are provided in the housing 201. The platen 112 rotates in response to a driving force that is from a driving source such as the platen motor and transmitted through the predetermined gear train 704.

The upper paper guide 108 and the print head 111 are provided in the cover member 202. Further, the ribbon unit 113 is provided in the cover member 202. As a result, the upper paper guide 108, the print head 111, and the ribbon unit 113 are displaced accompanying the rotation of the cover member 202 and are positioned at positions separate from the lower paper guide 109 and the platen 112, in a state where the cover member 202 is positioned at the open position. Further, in a state where the cover member 202 is positioned at the open position, the inner ribbon mounting opening 702 in the cover member 202 is open to the outside.

In this manner, the upper paper guide 108 and the lower paper guide 109 as well as the print head 111 and the platen 112 are separated from each other, whereby the recording medium conveyance path 106 can be open to the outside. As a result, in state with the recording medium holding unit 103 mounted, the recording medium that is pulled out from the end on the outer circumferential side and into the recording medium conveyance path 106 is pulled out to the front of the housing 201, passing on top of the lower paper guide 109 and the platen 112 and in this state, the recording medium can be set in the printer body 101 by a simple operation of merely positioning the cover member 202 at the closed position.

The upper paper guide 108 is disposed enabling rotation of the upper guide 108 with respect to the cover member 202. The upper paper guide 108, in a state in which the cover member 202 is positioned at the open position, rotates between a ribbon guide position whereby the print head 111 covers the ink ribbon 302 on a side closer to the recording medium holding unit 103 than the recording position, and a ribbon open position whereby the ribbon unit 113 is open to the outside. The upper paper guide 108, in a state positioned at the ribbon open position, opens the ink ribbon 302 to the outside through the inner ribbon mounting opening 702.

As described, the upper paper guide 108 is displaced accompanying the rotation of the cover member 202 and the upper paper guide 108 itself rotates with respect to the cover member 202. Therefore, in a state where the cover member 202 is positioned at the open position, when the upper paper guide 108 is positioned at the ribbon open position, the ribbon unit 113 can be opened to the outside.

As a result, work for the ink ribbon 302 that is passed between the ribbon support axle 114 and the ribbon take-up axle 115 can be performed through the inner ribbon mounting opening 702. In particular, in work for replacing the ink ribbon 302 that is wound around both the ribbon support axle 114 and the ribbon take-up axle 115 as a consequence of being in use, the state of the ink ribbon 302 that is in use can be confirmed easily through the inner ribbon mounting opening 702 while work of mounting the ribbon support axle 114 and the ribbon take-up axle 115 is performed from the outer ribbon mounting opening 301 side. As a result, the replacement work for the ink ribbon 302 can be performed in a stable posture and during replacement work, the ink ribbon 302 can be prevented from being damaged such as being cut or marred.

Figure 8:
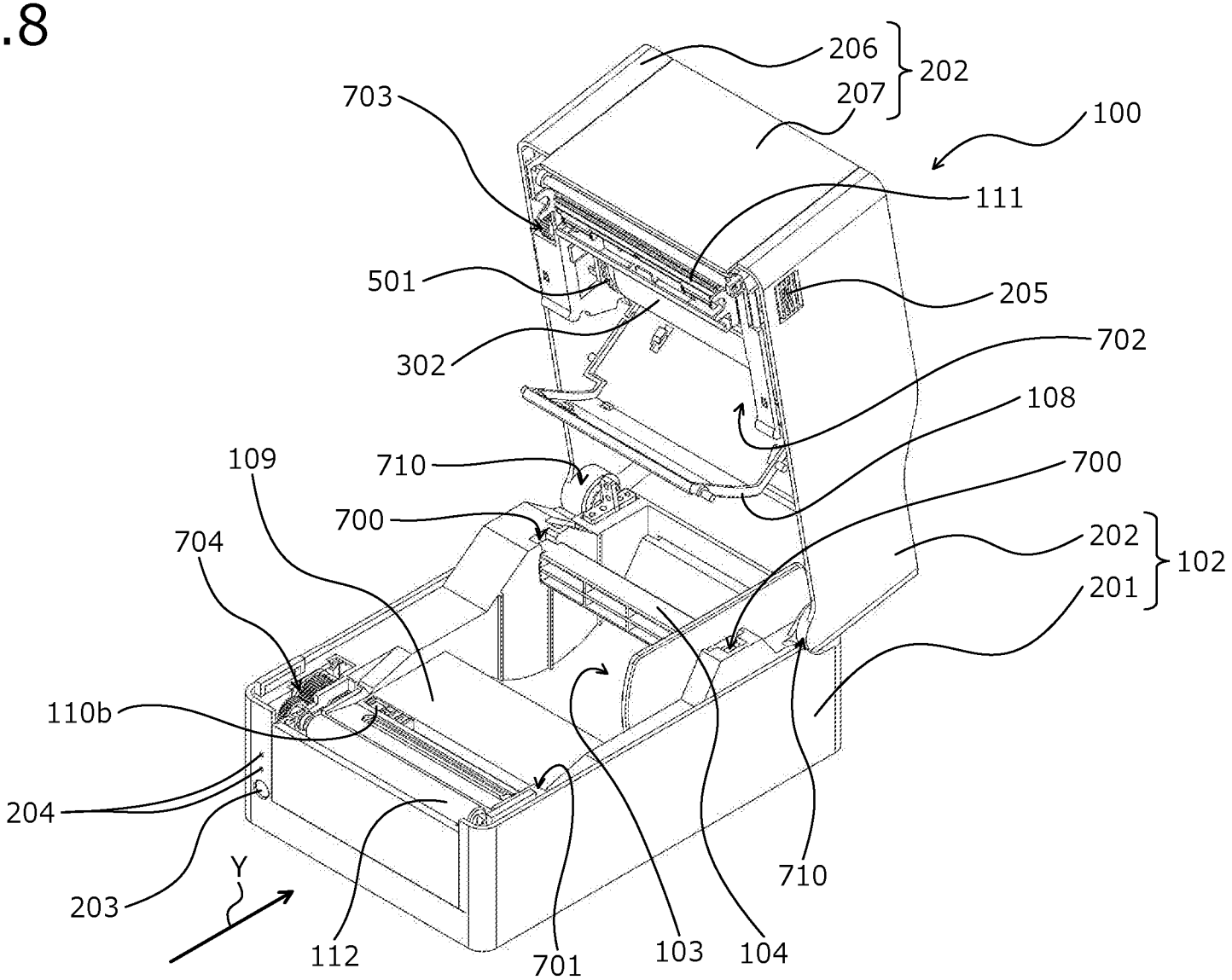
FIG. 8 is an explanatory drawing depicting a state in which an upper paper guide of the printer depicted in FIG. 7 is positioned at a ribbon open position.
Figure 9:
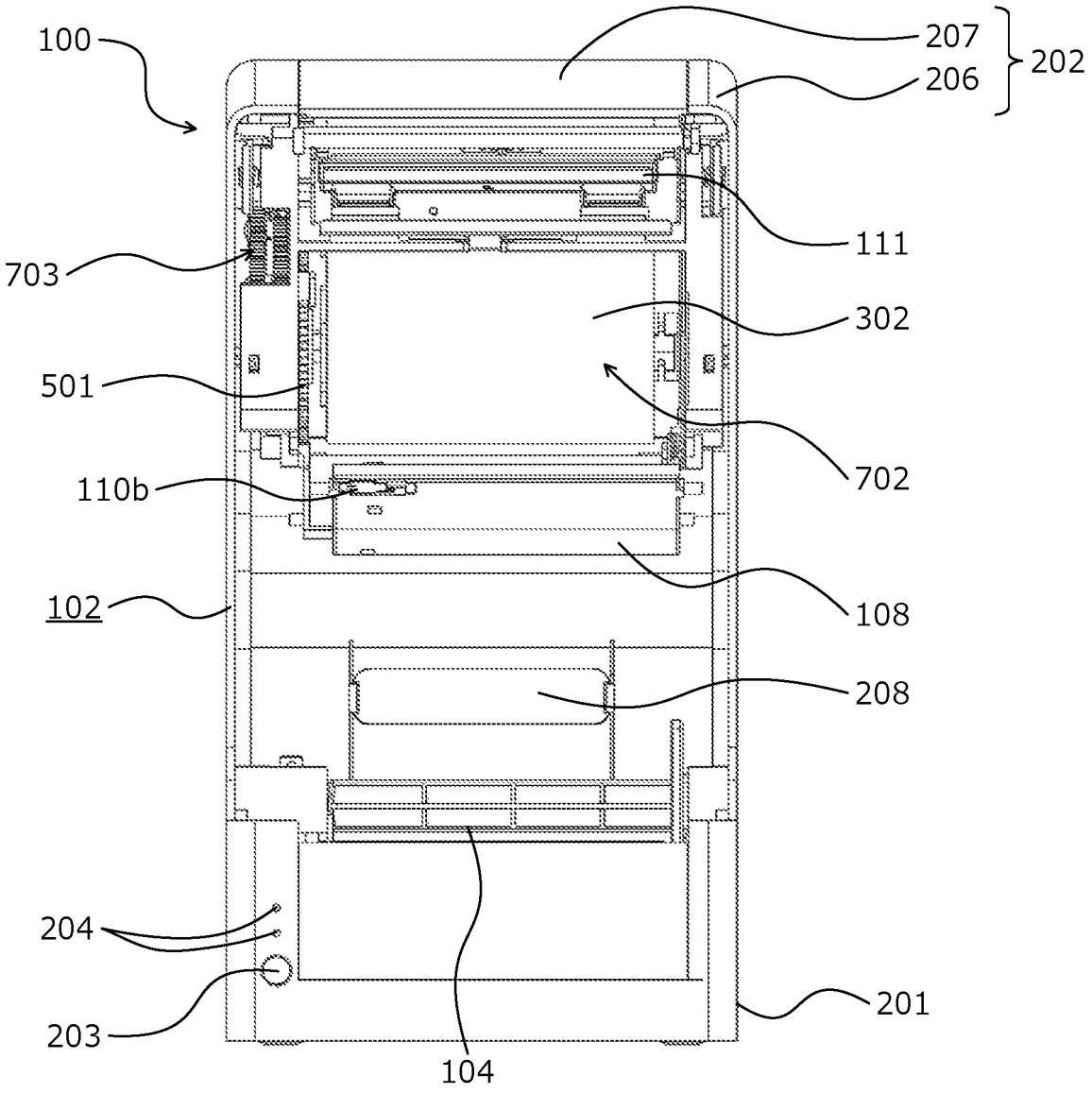
FIG. 9 is an explanatory drawing depicting a state of the printer depicted in FIG. 8, as viewed along a direction indicated by arrow Y.

FIG. 8 is an explanatory drawing depicting a state in which the upper paper guide 108 of the printer 100 depicted in FIG. 7 is positioned at the ribbon open position. FIG. 9 is an explanatory drawing depicting a state of the printer 100 depicted in FIG. 8, as viewed along a direction indicated by arrow Y. In FIGS. 8 and 9, a lower part of the ribbon unit 113 can be open to the outside through the inner ribbon mounting opening 702 by positioning the upper paper guide 108 at the ribbon open position.

As a result, when the ink ribbon 302 is mounted or replaced, work can be performed directly on the ink ribbon 302 from the surface toward the platen 112 at the print head 111 and therefore, the ink ribbon 302 can be assuredly passed between the ribbon support axle 114 and the ribbon take-up axle 115 without damaging the ink ribbon 302.

Furthermore, in a state where the cover member 202 is positioned at the open position and the top cover 207 is positioned at the open position, an upper part and the lower part of the ribbon unit 113 can be opened to the outside. As a result, the work for mounting and removing the ribbon support axle 114 and/or the ribbon take-up axle 115 can be performed through the third opening 301 and the work for passing the ink ribbon 302 can be performed through the inner ribbon mounting opening 702.

In this manner, work is performed at an optimal position corresponding to the contents of the work, thereby facilitating the work for mounting and removing the ink ribbon 302 and enabling enhancement of the workability for mounting and removing the ink ribbon 302.

At the start of use of the ink ribbon 302, a greater part of the ink ribbon 302 that is passed between the ribbon support axle 114 and the ribbon take-up axle 115 is wound around the ribbon support axle 114. Further, after use of the ink ribbon 302, a greater part of the ink ribbon 302 passed between the ribbon support axle 114 and the ribbon take-up axle 115 is wound around the ribbon take-up axle 115.

In this manner, whichever of the ribbon support axle 114 and the ribbon take-up axle 115 whose shaft member has the ink ribbon 302 disproportionately wound there around has weight. The work of mounting or removing with respect to the printer body 101, the ribbon support axle 114 or the ribbon take-up axle 115 having such weight is preferably performed in a posture that does not strain the worker.

The printer 100 of the first embodiment enables work for mounting and/or removing the ribbon support axle 114 and/or the ribbon take-up axle 115 with respect to the printer body 101, to be performed from above the ribbon support axle 114 and/or the ribbon take-up axle 115. As a result, the worker can perform the work in a stable posture, while looking down at the ribbon support axle 114 or the ribbon take-up axle 115 having weight. Further, as a result, fatigue of the worker caused by performing the work in a posture such that the worker looks in at the ink ribbon 302 from below is eliminated, whereby the work for mounting or removing the ink ribbon 302 is facilitated and the workability for mounting and removing the ink ribbon 302 can be enhanced.

Second Embodiment

The printer of the second embodiment according to the present invention will be described. In the second embodiment, parts identical to those of the first embodiment are indicated by the same reference numerals used in the first embodiment and description thereof is omitted hereinafter. In the first embodiment described, while the printer 100 that includes the upper paper guide 108 has been described, the printer according to the present invention, for example, as depicted in FIG. 10, needs not include the upper paper guide 108.

(Configuration of Printer)

Figure 10:
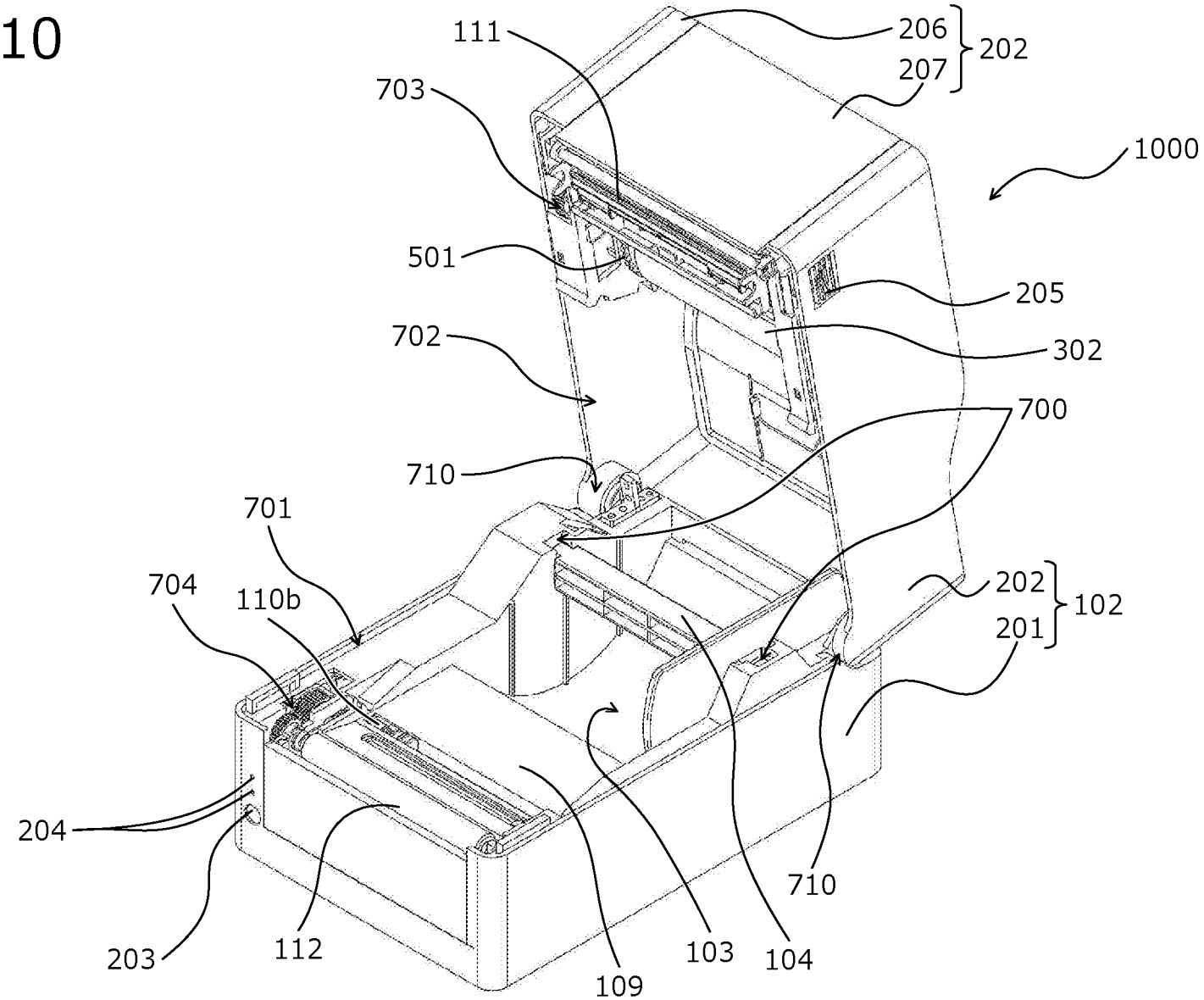
FIG. 10 is an explanatory drawing (part 1) depicting the printer of a second embodiment according to the present invention.
Figure 11:
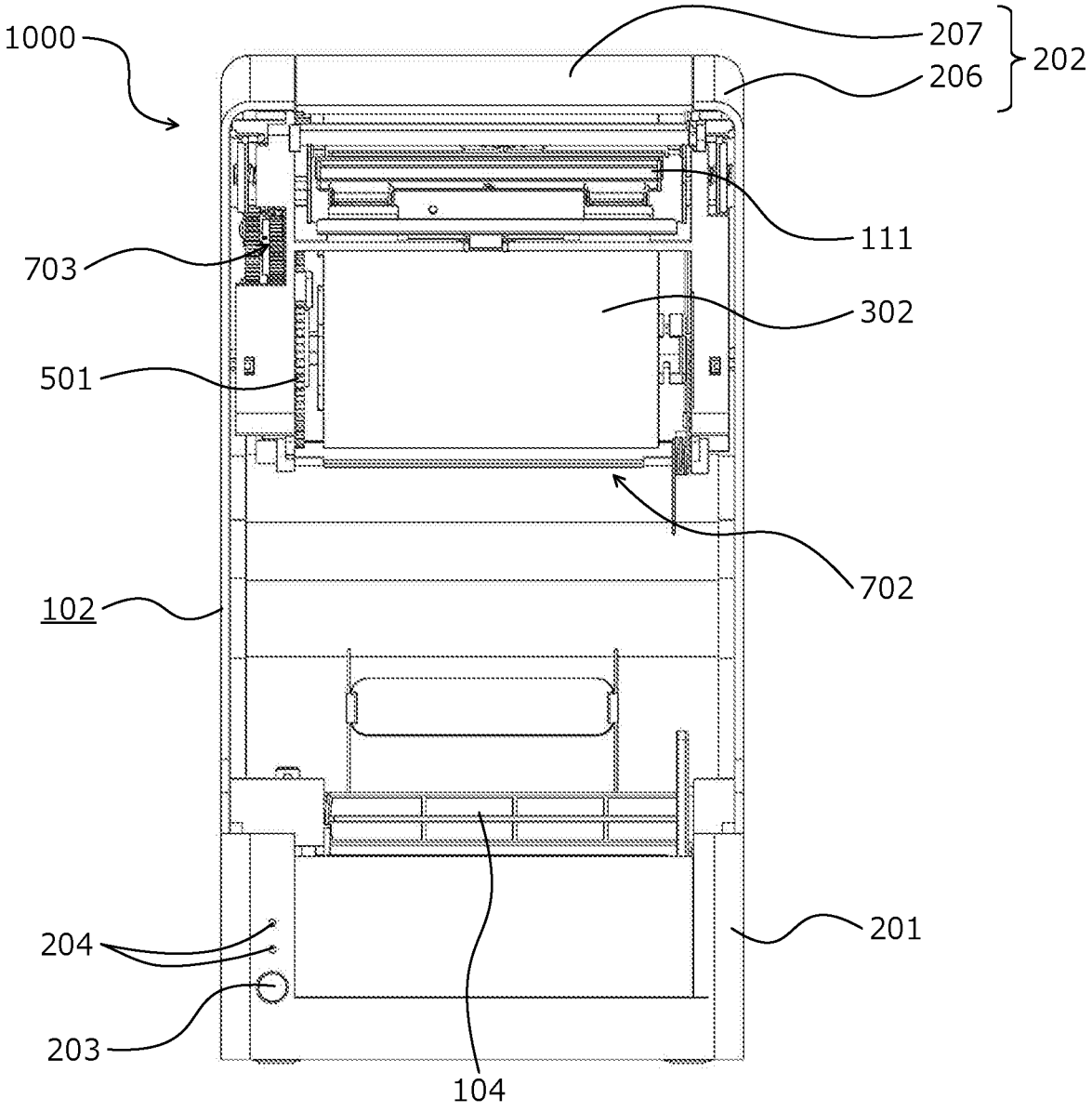
FIG. 11 is an explanatory drawing (part 2) depicting the printer of the second embodiment according to the present invention.

FIGS. 10 and 11 are explanatory drawings depicting a configuration of the printer 100 of the second embodiment according to the present invention. In FIGS. 10 and 11, a printer 1000 of the second embodiment does not include the upper paper guide 108 in the printer 1000 described above. In the printer 1000 as such, the lower part of the ink ribbon 302 can be opened to the outside immediately by positioning the cover member 202 at the open position.

Further, in a state where the cover member 202 is positioned at the open position, a wide work space can be established at the lower part of the ink ribbon 302. As a result, fatigue of the worker caused by performing the work in a posture such that the worker looks at the ink ribbon 302 from below is eliminated, whereby the work for mounting or removing the ink ribbon 302 is facilitated and the workability for mounting and removing the ink ribbon 302 can be enhanced.

As depicted in FIGS. 10 and 11, in the printer 1000 that does not include the upper paper guide 108 that is displaced accompanying rotation of the cover member 202, a damper member that controls the position of the recording medium may be provided to prevent unintended marks on the recording medium due to the recording medium contacting the ink ribbon 302.

The damper member, for example, can be realized by a member having a rod-shape and at a same position as a bent part in the upper paper guide 108, can be positioned so as to extend along the main scanning direction. The damper member may be mounted to the housing 201, or may be mounted to the cover member 202. Further, the damper member needs not have a rod-shape provided the damper member has a controlling action.

Third Embodiment

The printer of the third embodiment according to the present invention will be described. In the third embodiment, parts identical to those in the first embodiment and the second embodiment are indicated by the same reference numerals used in the first and the second embodiments, and description thereof will be omitted hereinafter.

(Configuration of Printer)

Figure 12:
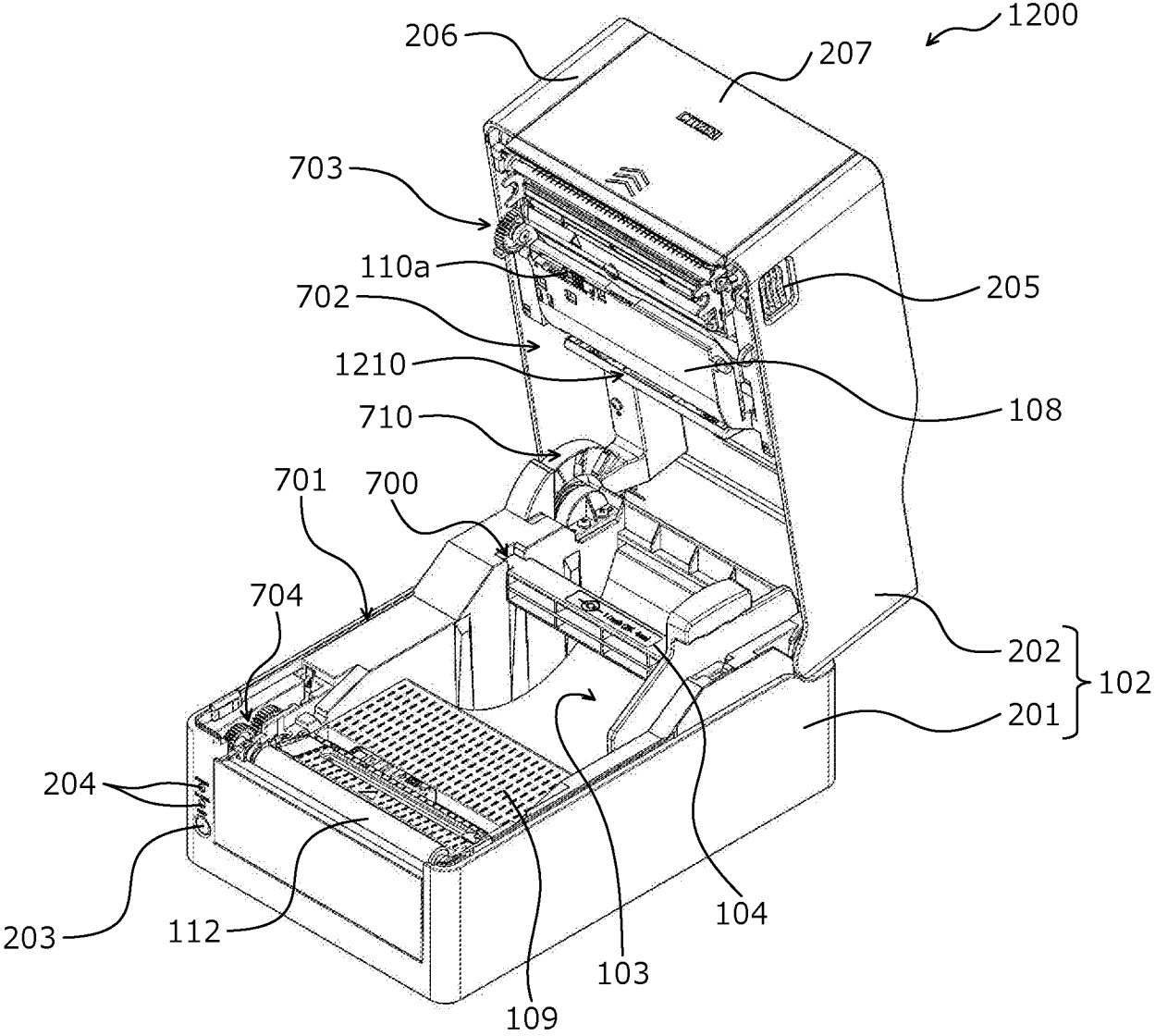
FIG. 12 is an explanatory drawing depicting a configuration of the printer of a third embodiment according to the present invention.

FIG. 12 is an explanatory drawing depicting a configuration of the printer of the third embodiment according to the present invention. In FIG. 12, a state is depicted in which the top cover 207 of the printer of the third embodiment according to the present invention is positioned at the open position.

In FIG. 12, a printer 1200 of the third embodiment includes a damper member 1210. The damper member 1210 is provided to the upper paper guide 108. The damper member 1210 is provided in the upper paper guide 108 and therefore, accompanying the opening and closing of the cover member 202, is displaced together with the upper paper guide 108. The damper member 1210, in the upper paper guide 108, is provided closer to the recording medium holding unit 103 than is a front end on the recording unit 105 side.

(Configuration of Damper Member 1210)

Figure 13A:
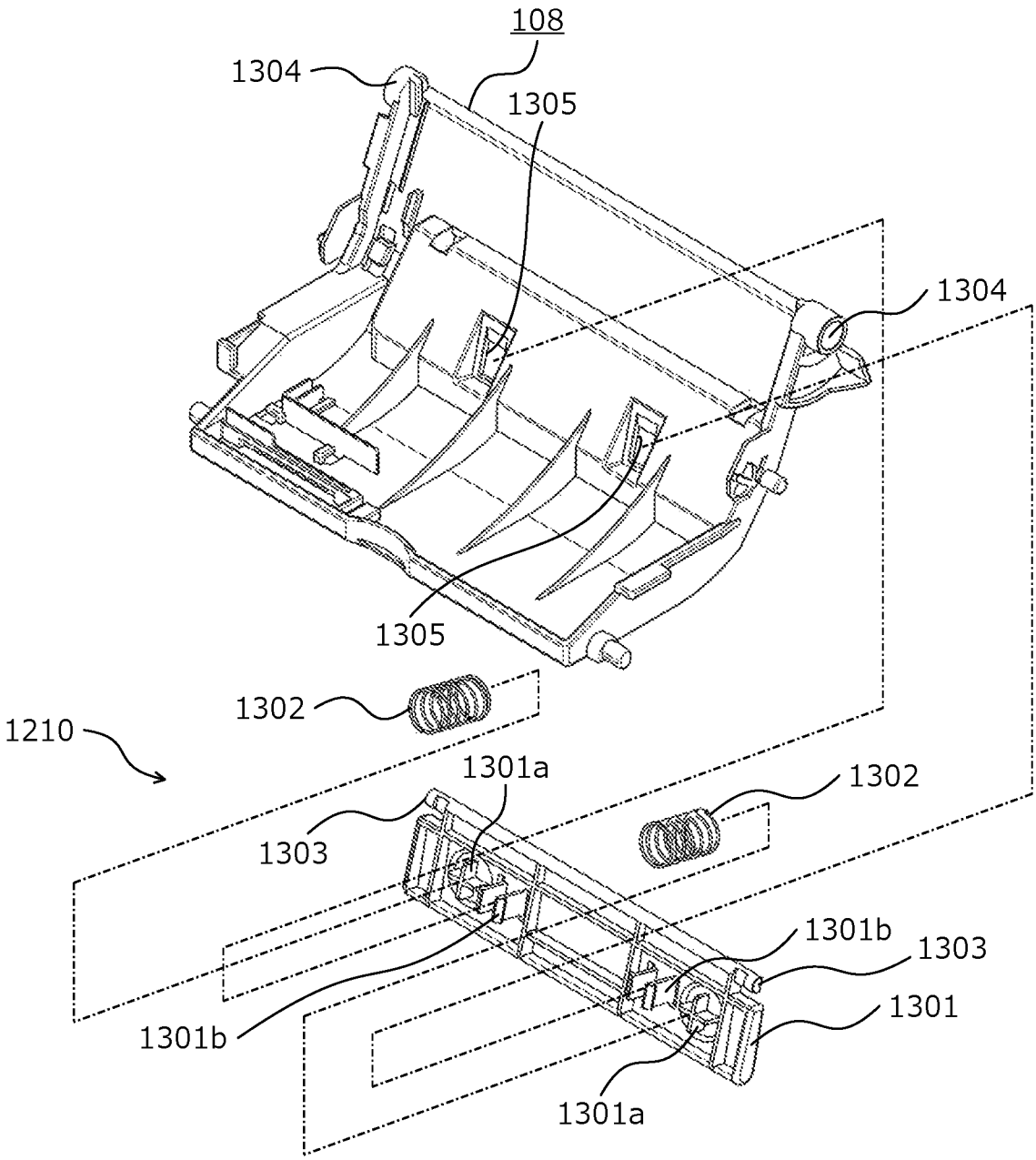
FIG. 13A is an exploded perspective view depicting the upper paper guide and a damper member.
Figure 13B:
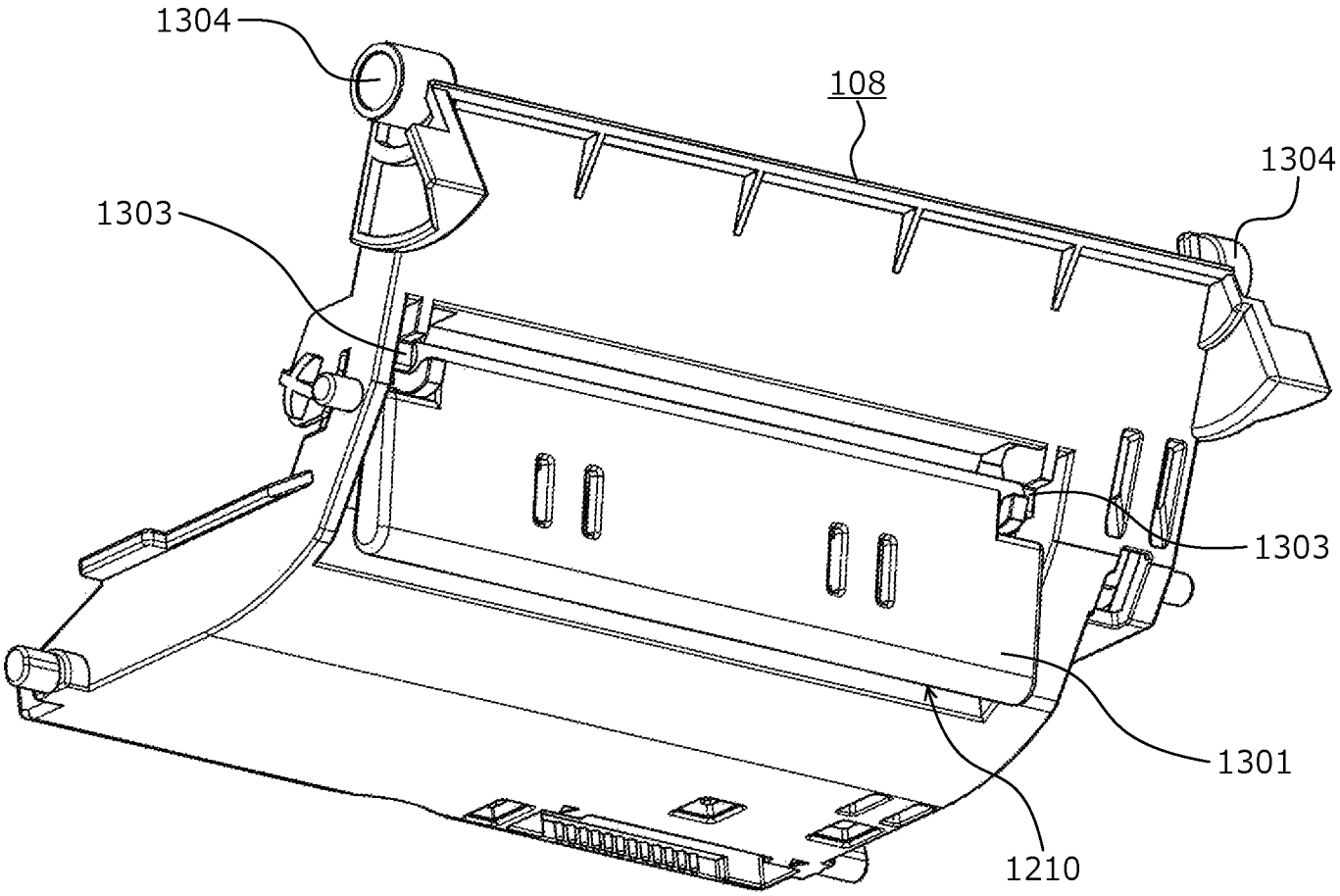
FIG. 13B is a perspective view depicting the upper paper guide and the damper member.

Configuration of the damper member 1210 will be described. FIG. 13A is an exploded perspective view depicting the upper paper guide 108 and the damper member 1210. FIG. 13B is a perspective view depicting the upper paper guide 108 and the damper member 1210.

In FIG. 13A, the upper paper guide 108 and the damper member 1210 in the disassemble state are depicted as viewed from the ribbon unit 113 side. In FIG. 13B, the upper paper guide 108 and the damper member 1210 in a state of being mounted to the upper paper guide 108 are depicted as viewed from a side that is closer to the rear side than are the upper paper guide 108 and the damper member 1210, and from the lower paper guide 109 (lower part) side.

In FIGS. 13A and 13B, the damper member 1210 is configured by a contact member 1301 and a biasing member 1302. The contact member 1301 is realized by a plate member having a substantially rectangular shape. The contact member 1301 includes an axial part 1303 and via the axial part 1303, is axially supported enabling rotation with respect to the upper paper guide 108. The axial part 1303, in particular, is provided so as to protrude outside of the contact member 1301, along an extending direction of an upper edge of the contact member 1301.

The axial part 1303 that is a rotational axle of the contact member 1301 is axially supported by the upper paper guide 108, in a vicinity of a rotational axle 1304 of the upper paper guide 108 for the cover member 202. In particular, the contact member 1301 that is at the rear side of the upper paper guide 108 is axially supported enabling rotation with respect to the upper paper guide 108 by engaging the axial part 1303 with a projection for engagement, having a rib-shape and provided at both ends of the upper paper guide 108 in the width direction.

Connecting the contact member 1301 to the upper paper guide 108 in a vicinity of the rotational axle 1304 of the upper paper guide 108 enables the damper member 1210 to be stabilized and supported, and even when an external force is applied, the damper member 1210 can be stably operated.

The contact member 1301 is disposed in a state having one side facing toward the recording medium holding unit 103 (the recording medium held by the recording medium holding unit 103) and the other side facing oppositely toward the upper paper guide 108. The biasing member 1302 is provided at the other side of the contact member 1301 facing toward the upper paper guide 108. The biasing member 1302 has elasticity and is deformed by an applied external force and returns to the original shape when released from the external force. The biasing member 1302 is disposed in a state in which one part is in contact with the other surface of the contact member 1301 and a different part is in contact with a surface on the recording medium holding unit 103 side in the upper paper guide 108.

The biasing member 1302, for example, can be realized by a compression spring. When the biasing member 1302 is realized by a compression spring, a protrusion 1301*a* is provided at the other surface of the contact member 1301 and an inner cylindrical space formed by the compression spring is fitted with the protrusion 1301*a*, whereby the position of the biasing member 1302 can be fixed with respect to the contact member 1301.

Further, a cantilever snap member 1301*b* to prevent falling away is provided at the other surface of the contact member 1301. The cantilever snap member 1301*b* protrudes from the other surface of the contact member 1301 and has a tip part that is bent in a hook-shape. The cantilever snap member 1301*b* forms a pair with a cantilever snap member

1301*b* bent in the opposite direction. Multiple pairs of the cantilever snap members 1301*b* are provided to the contact member 1301.

During work for mounting the damper member 1210 to the upper paper guide 108, first, the contact member 1301 is axially supported with respect to the upper paper guide 108. Next, the contact member 1301 is rotated in a direction pushing the upper paper guide 108 and the cantilever snap member 1301*b* is pushed into a through-hole 1305 provided in the upper paper guide 108.

When the cantilever snap member 1301*b* is pushed, a front end part is deformed so as to circumvent an edge of the through-hole 1305, whereby the cantilever snap member 1301*b* penetrates the through-hole 1305. Further, after the front end part penetrates the through-hole 1305, the cantilever snap member 1301*b* returns to the original shape due to elasticity of the cantilever snap member 1301*b*. By returning to the original shape, the front end part of the cantilever snap member 1301*b* interlocks with the edge of the through-hole 1305.

The contact member 1301, in a state where no external force is applied to the damper member 1210, is biased by the biasing force of the biasing member 1302 and positioned at a position separated from the upper paper guide 108. The position of the contact member 1301 that is biased by the biasing member 1302 is controlled so as to not be separated from the upper paper guide 108 by a predetermined distance or more as a consequence of the front end part of the cantilever snap member 1301*b* being interlocked with the edge of the through-hole 1305.

At the damper member 1210, the position of the contact member 1301 is prevented from becoming unstable by the biasing member 1302 provided between the upper paper guide 108 and the contact member 1301 and by the cantilever snap member 1301*b* interlocked with the through-hole 1305. As a result, the position of the contact member 1301 can be stabilized.

When an external force biasing the contact member 1301 in a direction to approach the upper paper guide 108 is applied to the contact member 1301, the contact member 1301 resists the biasing force of the biasing member 1302 and is displaced in a direction to approach the upper paper guide 108, i.e., a direction to be separated from the recording medium conveyance path 106. Further, the contact member 1301, when released from the external force, is biased by the biasing force of the biasing member 1302 and is displaced in a direction to approach the recording medium conveyance path 106. In this manner, the contact member 1301 can be displaced along directions toward and away from the recording medium conveyance path 106.

(Operation of Damper Member 1210)

Figure 14:
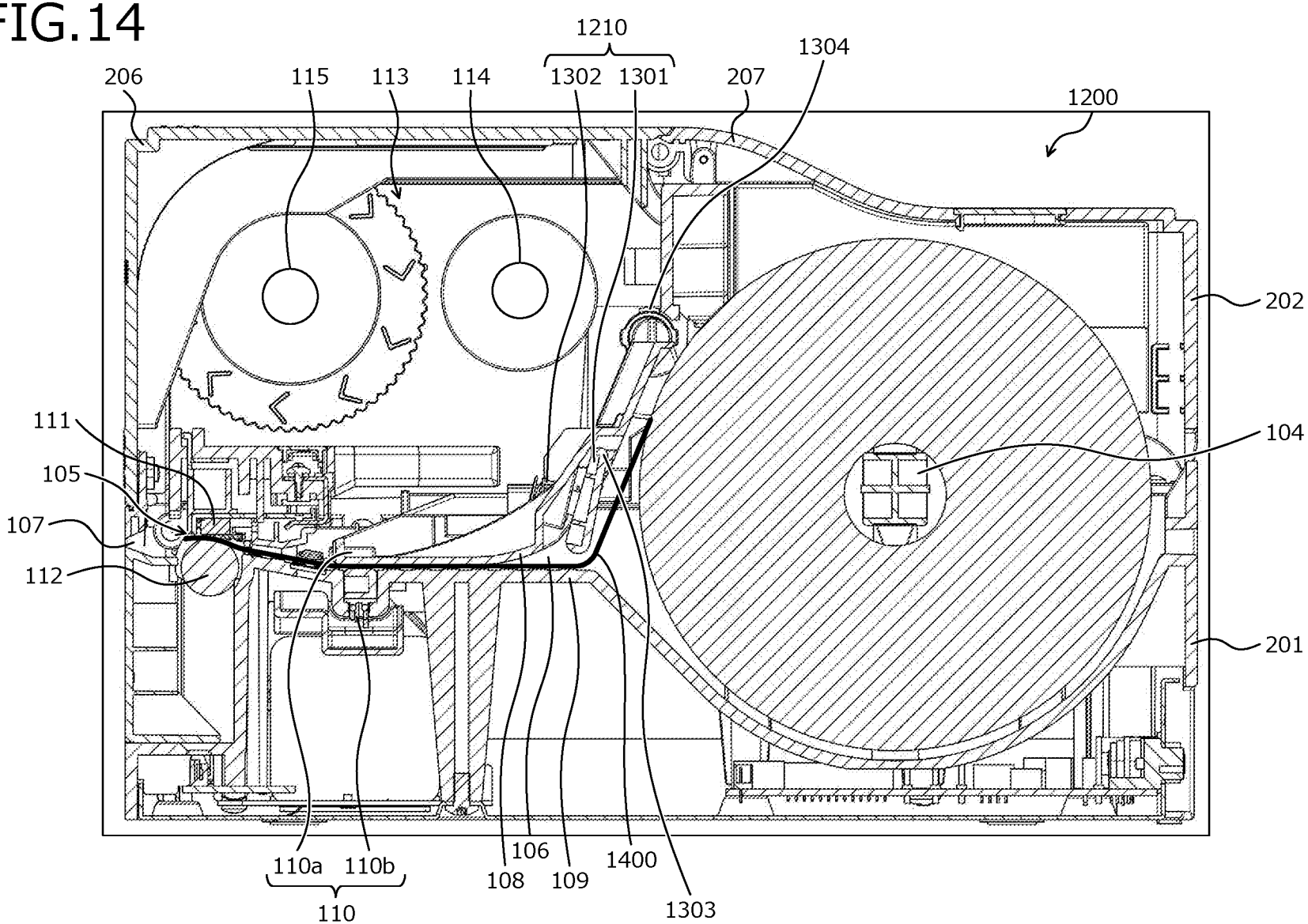
FIG. 14 is an explanatory drawing (part 1) depicting operation of the damper member in the printer of the third embodiment according to the present invention.
Figure 15:
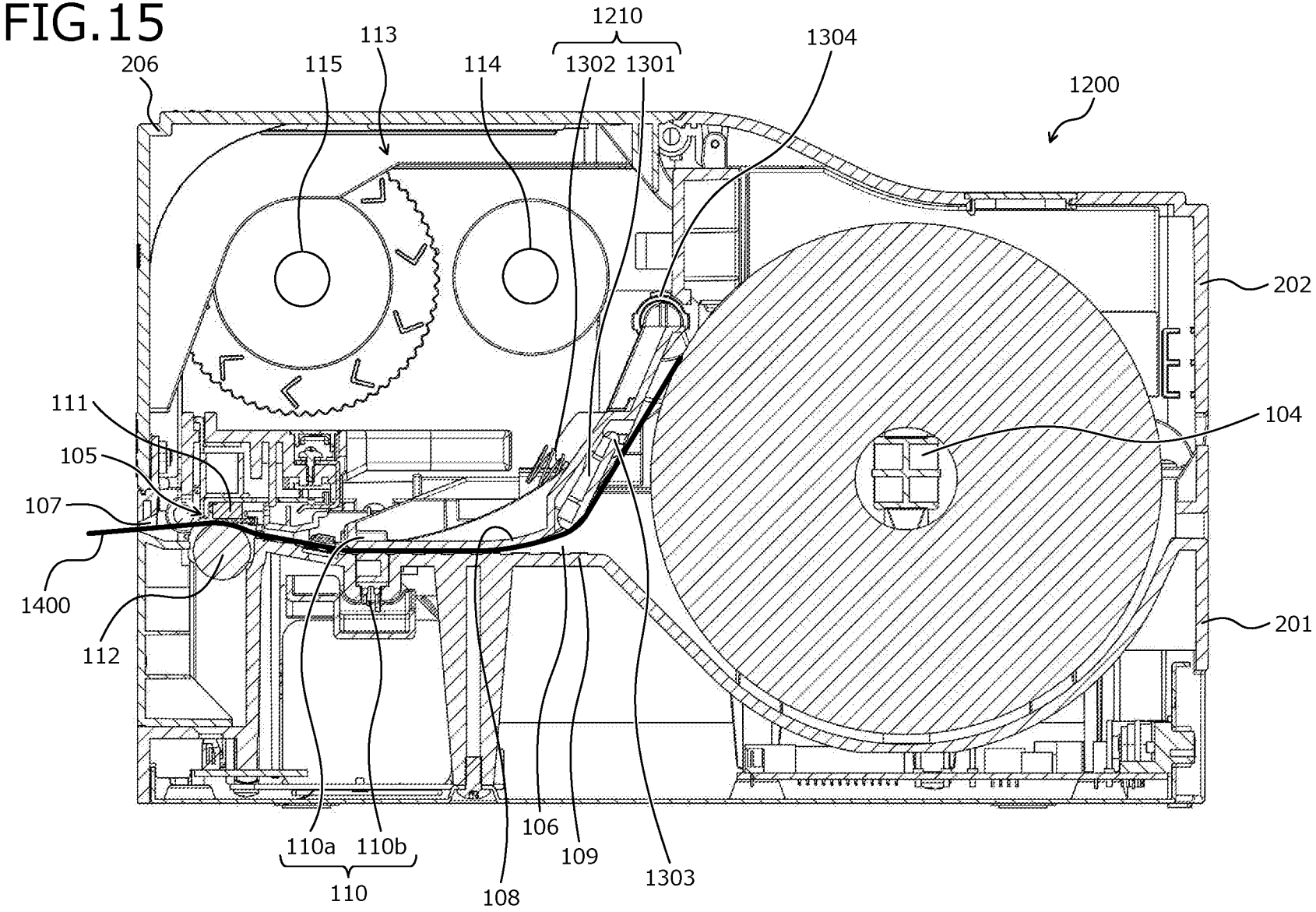
FIG. 15 is an explanatory drawing (part 2) depicting operation of the damper member in the printer of the third embodiment according to the present invention.

Operation of the damper member 1210 will be described. FIGS. 14 and 15 are explanatory drawings depicting operation of the damper member 1210 in the printer of the third embodiment according to the present invention. FIGS. 14 and 15 depict a cross-section of the printer of the third embodiment according to the present invention, cut along the sub-scanning direction. FIG. 14 depicts a state in which the damper member 1210 is not in operation and FIG. 15 depicts a state in which the damper member 1210 is operating.

A recording medium 1400 wound in a roll and held by the recording medium holding unit 103 is pulled out from the end on the outer circumferential side into the recording medium conveyance path 106 and is subject to the recording operation by the recording unit 105. During the recording operation, the platen 112 that rotates in a predetermined direction applies tension to the recording medium 1400 that has been pulled into the recording medium conveyance path 106. Further, when the recording operation ends, rotation of the platen 112 to pull out the recording medium 1400 from the outer circumferential side is suspended, the recording medium 1400 being wound in a roll.

At this time, even after rotation of the platen 112 is suspended, the recording medium 1400 wound in a roll rotates slightly at the recording medium holding unit 103 due to inertia of the recording medium 1400. As a result, the recording medium 1400 pulled into the recording medium conveyance path 106 is in a slack state when the recording operation is not being performed. In this state, no external force acts against the damper member 1210 and as depicted in FIG. 14, the contact member 1301 in the damper member 1210 is in a state of protruding maximally toward the recording medium conveyance path 106 due to the biasing force of the biasing member 1302.

From the state depicted in FIG. 14, when the recording operation is again performed and the platen 112 rotates, the rotational force of the platen 112 is transmitted to the recording medium 1400 and tension is applied to the recording medium 1400. The recording medium 1400 to which the tension is applied is lead to the shortest path between the recording medium holding unit 103 and the recording unit 105, and goes from a state of being slack to a state of being taut.

The shortest path between the recording medium holding unit 103 and the recording unit 105 is a path routed so as to follow the upper paper guide 108, interposed with the contact member 1301 that protrudes toward the recording medium conveyance path 106 to a greater extent than does the upper paper guide 108. Therefore, the contact member 1301 is biased by the recording medium 1400 that goes from the state of being slack to the state of being taut, rotates around a rotational axle 1303 and as depicted in FIG. 15, due to the recording medium 1400 lead from the recording medium holding unit 103 to the recording unit 105, resists the biasing force of the biasing member 1302 and is displaced in a direction away from the recording medium holding unit 103.

When the recording medium 1400 is pulled out, initially, a load caused by the inertia of the recording medium 1400 acts on the recording medium 1400. The load applied to the pulling out of the recording medium 1400 is greater, the greater is the amount of the recording medium 1400 remaining in the recording medium holding unit 103. When the load applied to the pulling out of the recording medium 1400 of the recording medium 1400 is large, the tension applied to the recording medium 1400 passed between a pull-out position from the recording medium holding unit 103 and the recording unit 105 is high.

When the damper member 1210 is not present, the load applied to the pulling out of the recording medium 1400 of the recording medium 1400 acts directly on the recording medium 1400 at the recording unit 105. In particular, the load applied to the pulling out of the recording medium 1400 of the recording medium 1400 acts to pull the recording medium 1400 from the recording unit 105 toward the recording medium holding unit 103. Depending on the magnitude of the load applied to the pulling out of the recording medium 1400 of the recording medium 1400, there is a risk of the recording position shifting, reducing the recording quality. Further, depending on the magnitude of load applied to the pull, there is a risk of the recording medium 1400 becoming damaged.

In contrast, in the printer 1200, the damper member 1210 is provided and therefore, when the recording medium 1400 is pulled out, the contact member 1301 elastically abuts the recording medium 1400 while resisting the biasing force of the biasing member 1302 and being displacing in a direction away from the recording medium conveyance path 106. As a result, the load applied to the pulling out of the recording medium 1400 of the recording medium 1400 is suppressed from being abruptly applied to the recording medium 1400, enabling the impact (inertial force) applied to the recording medium 1400 to be lessened. In this manner, during pull out, the load applied to the recording medium 1400 is mitigated, enabling the recording medium 1400 to be conveyed with accuracy.

Here, assuming a case where the damper member 1210 is provided in the housing 201, to open the recording medium conveyance path 106, the cover member 202 and the damper member 1210 each has to be manipulated, and the work is anticipated to be troublesome. Further, assuming a case where the damper member 1210 is provided in the cover member 202, in order to not disturb rotation of the upper paper guide 108, limiting the mounting position of the damper member 1210 and effectively reducing the load applied to the pulling out of the recording medium 1400 of the recording medium 1400 are anticipated to be difficult.

In contrast, according to the printer 1200, the damper member 1210 is provided to the upper paper guide 108, whereby during maintenance and the like, the recording medium holding unit 103 and the recording medium conveyance path 106 can be easily opened by merely positioning the cover member 202 at the open position. Further, according to the printer 1200, provision of the damper member 1210 to the upper paper guide 108 enables the load applied to the pulling out of the recording medium 1400 of the recording medium 1400 to be effectively reduced at an optimum position, without disturbing the rotation of the upper paper guide 108.

In this manner, according to the printer 1200, enhancement of the workability for mounting and removing the ink ribbon 302 is facilitated and during pull out, the load applied to the recording medium 1400 is mitigated, enabling conveyance accuracy of the recording medium 1400 to be ensured.

Wiring of the damper member 1210 is unnecessary. Provision of such a damper member 1210 to the upper paper guide 108 and not to the lower paper guide 109 enables a wide space to be established in the housing 201 as compared to a case in which the damper member 1210 is provided in the housing 201.

Here, in a general printer, a power source is provided in the housing 201 and not on the cover member 202 side. In this case, when a member such as a control circuit board that receives power supply from the power source or a sensor is provided to the cover member 202 that rotates with respect to the housing 201, wiring related to power supply or control signal transmission has to be routed through a periphery of the hinge 710. On the other hand, the routing position of the wiring is more preferably a fixed position than a movable position.

In the printer 1200, the damper member 1210 is provide to the upper paper guide 108, whereby during the pulling out of the recording medium 1400, the load applied to the recording medium 1400 is mitigated and space for disposing members required for wiring in the housing 201 can be established in the housing 201 and therefore, the limited space in the case 102 is effectively utilized, facilitating reductions in the size of the printer 1200 and enabling the occurrence of problems such as the disconnection of wiring to be suppressed.

In the embodiments described above, while the printers 100, 1000, 1200 that include the recording unit 105 that uses a thermal head to perform a recording operation have been described, a recording method of the recording unit 105 is not limited to a thermal method. The recording unit 105, in place of the thermal head that performs recording by a thermal method, may include an impact print head 111 that performs recording by an impact method. The impact print head 111 includes a bundle of plural wire pins and a structure in which front ends of the wire pins are disposed in a matrix-like shape. The wire pins are independent of each other and are capable of protruding toward the recording medium 1400.

The impact print head 111 is provided enabling reciprocal motion along the main scanning direction (the width direction of the recording medium). The recording unit 105 that includes the impact print head 111 further includes a driver IC that selectively protrudes the wire pins included in the impact print head 111, a drive mechanism that reciprocally moves the impact print head 111 along the main scanning direction, and a driving source such as a motor that imparts a driving force that drives the drive mechanism and reciprocally moves the impact print head 111.

The recording unit 105 that includes the impact print head 111, while reciprocally moving the impact print head 111 along the main scanning direction, selectively strikes the wire pins against the recording medium 1400, via the ink ribbon 302, producing a small point (dot) on the recording medium 1400, whereby a character, for example is recorded. The impact print head 111 can be easily realized using a commonly known technique and therefore, description thereof will be omitted.

As described, the printers 100, 1000, 1200 of the embodiments according to the present invention include the platen 112 provided in the housing 201 having a substantially box-shape and including the housing opening 701; the cover member 202, as a cover that has a substantially box-shape including the inner ribbon mounting opening 702 that opens facing in the other direction opposite that of the housing opening 701, the cover member 202 being a cover that is connected to the housing 201 via the hinge 710 enabling rotation with respect to the housing 201 and that can be positioned at the closed position whereby the inner ribbon mounting opening 702 is caused to oppose the housing opening 701 by rotating using the hinge 710 as a center and can be positioned at the open position whereby the inner ribbon mounting opening 702 is open; and the print head 111 that is provided in the cover member 202 and that opposes the platen 112 in a state where the cover member 202 is positioned at the closed position.

Further, the printers 100, 1000, 1200 of the embodiments according to the present invention further include the ribbon support axle 114 and the ribbon take-up axle 115 as a pair of shaft members that in the cover member 202, at a side closer the inner ribbon mounting opening 702 than the print head 111, is provided enabling rotation around an axis parallel to the main scanning direction and that in a state where the cover member 202 is positioned at the closed position, holds the ink ribbon 302 to freely feed and freely take up the ink ribbon 302 positioned between the platen 112 and the print head 111. The printers 100, 1000, 1200 of the embodiments according to the present invention are characterized in that the cover member 202, at the side opposite that of the inner ribbon mounting opening 702, includes the outer ribbon mounting opening 301 that opens the print head 111, the ribbon support axle 114, and the ribbon take-up axle 115 to the outside.

According to the printers 100, 1000, 1200 of the embodiments according to the present invention, work on the print head 111 and the ribbon support axle 114 and/or the ribbon take-up axle 115 can be performed via the inner ribbon mounting opening 702 and the outer ribbon mounting opening 301. For example, via the outer ribbon mounting opening 301, mounting of the ink ribbon 302 to the ribbon support axle 114 or the ribbon take-up axle 115 is performed and the work of leading the ink ribbon 302 to the side closer toward the platen 112 than the side toward the print head 111 can be performed through the inner ribbon mounting opening 702.

In this manner, according to the work contents, the outer ribbon mounting opening 301 or the inner ribbon mounting opening 702 can be selectively used to perform the work, whereby fatigue of the worker is eliminated and the work for mounting and/or removing the ink ribbon 302 is facilitated, enabling enhancement of the workability for mounting and removing the ink ribbon 302.

In particular, work is performed through the outer ribbon mounting opening 301, whereby work for mounting or removing the ink ribbon 302 with respect to the ribbon support axle 114 or the ribbon take-up axle 115 can be performed from above the printers 100, 1000, 1200, the ink ribbon 302 having weight in a state of being wound around only one of the ribbon support axle 114 and the ribbon take-up axle 115 such as at the start of use or after use. As a result, the worker can perform the work in a stable posture in state of looking downward at the ribbon support axle 114 and/or the ribbon take-up axle 115 having weight.

Further, as a result, with the printers 100, 1000, 1200, fatigue of the worker due to performing the work in a posture of looking at the ink ribbon 302 from below by a conventional technique is eliminated and the word for mounting and removing the ink ribbon 302 is facilitated, whereby the workability for mounting and removing the ink ribbon 302 can be enhanced.

Further, the work is performed through the inner ribbon mounting opening 702, whereby the work can be performed from the side of the ink ribbon 302 passed farther on the platen 112 side than the print head 111. As a result, during the work, without the ribbon support axle 114 or the ribbon take-up axle 115 becoming obstacles, the work for the ink ribbon 302 can be performed easily.

Further, as a result, with the ink ribbon 302 in a state of being wound around both the ribbon support axle 114 and the ribbon take-up axle 115, i.e., in a state of being in use, when the ink ribbon 302 is replaced, easy removal without damaging the ink ribbon 302 such as cutting the ink ribbon 302 is possible, enabling the workability for mounting and removing the ink ribbon 302 to be enhanced.

Moreover, according to the printers 100, 1000, 1200 of the embodiments according to the present invention, the ribbon support axle 114 and the ribbon take-up axle 115 are provided farther on the inner ribbon mounting opening 702 side than the print head 111, enabling both a size reduction of a dimension in the sub-scanning direction of the printers 100, 1000, 1200 and enhancement of the workability of the mounting and removal of the ink ribbon 302 with respect to the ribbon support axle 114 and the ribbon take-up axle 115.

In this manner, according to the printers 100, 1000, 1200 of the embodiments according to the present invention, irrespective of the weight of the ink ribbon 302 to be worked on, the workability for mounting and removing the ink ribbon 302 can be enhanced.

Further, the printers 100, 1000, 1200 of the embodiments according to the present invention are characterized in that in, in a plan view, the ribbon support axle 114 and the ribbon take-up axle 115 overlap the outer ribbon mounting opening 301 and the inner ribbon mounting opening 702. As a result, the outer ribbon mounting opening 301 that realizes the third opening opposes across the ribbon support axle 114 and the ribbon take-up axle 115, the inner ribbon mounting opening 702 that realizes the second opening.

According to the printers 100, 1000, 1200 of the embodiments according to the present invention, by positioning the top cover 207 and the cover member 202 at the open positions, work for the ink ribbon 302 passed between the ribbon support axle 114 and the ribbon take-up axle 115 can be performed from both the outer ribbon mounting opening 301 side and the inner ribbon mounting opening side.

As a result, while the state of the ink ribbon 302 during replacement work is visually confirmed, replacement work for the ink ribbon 302 can be performed in a stable posture and work for mounting and/or removing the ink ribbon 302 is facilitated, enabling the workability for mounting and removing the ink ribbon 302 to be enhanced.

Further, the printers 100, 1200 according to the embodiments of the present invention are characterized in that the printers 100, 1200 include, as a conveyance guide member, the upper paper guide 108 provided enabling with respect to the cover, rotation of the upper paper guide 108 between the ribbon guide position whereby the ink ribbon 302 held by the ribbon support axle 114 and the ribbon take-up axle 115 is covered from the inner ribbon mounting opening 702 side, and the ribbon open position whereby the ink ribbon 302 is open to the outside through the inner ribbon mounting opening 702.

According to the printers 100, 1000, 1200 of the embodiments according to the present invention, provision of the upper paper guide 108 enhances the workability with respect to the ink ribbon 302 in a mounted state and therefore, during maintenance work or the like, the ink ribbon 302 can be widely opened to the outside through the inner ribbon mounting opening 702 and during the recording operation, contact between the ink ribbon 302 and the recording medium 1400 can be prevented.

As a result, without reducing the workability with respect to the ink ribbon 302, unintended marks on the recording medium 1400 due to the recording medium 1400 contacting the ink ribbon 302 can be prevented irrespective of the outer diameter (remaining amount) of the recording medium 1400 heled by the recording medium holding unit 103.

Further, the printers 100, 1000, 1200 of the embodiments according to the present invention are characterized in that the outer ribbon mounting opening 301 has a dimension along the main scanning direction greater than dimensions along the main scanning direction of the ribbon support axle 114 and the ribbon take-up axle 115.

According to the printers 100, 1000, 1200 of the embodiments according to the present invention, the dimension along the main scanning direction of the outer ribbon mounting opening 301 is greater than the dimensions along the main scanning direction of the ribbon support axle 114 and the ribbon take-up axle 115 and therefore, during mounting or removal work for the ribbon support axle 114 and/or the ribbon take-up axle 115, the ribbon support axle 114 and/or the ribbon take-up axle 115 does not abut or catch on the cover member 202. As a result, the work of mounting or removing the ribbon support axle 114 and/or the ribbon take-up axle 115 performed through the outer ribbon mounting opening 301 can be performed smoothly, enabling the workability for mounting and removing the ink ribbon 302 to be enhanced.

Further, the printers 100, 1000, 1200 of the embodiments according to the present invention are characterized in that the outer ribbon mounting opening 301 is provided in the cover member 202, spanning two continuous faces.

According to the printers 100, 1000, 1200 of the embodiments according to the present invention, the outer ribbon mounting opening 301 is provided in the cover member 202, spanning two continuous faces and therefore, a wide work range for the ribbon support axle 114 and the ribbon take-up axle 115 can be ensured. As a result, work for the ribbon support axle 114 and/or the ribbon take-up axle 115 can be performed from a direction corresponding to the state in which the printer 100, 1000, 1200 is disposed, the posture of the worker, and the like; and the workability for mounting and removing the ink ribbon 302 can be enhanced.

Further, the printers 100, 1000, 1200 of the embodiments according to the present invention are characterized in that the printers 100, 1000, 1200 include the first upper guide member 602 and the second upper guide member 605 as guide members leading to the first support hole 601 and the second support hole 604 as support units that support the ribbon support axle 114 and the ribbon take-up axle 115, respectively, from the outer ribbon mounting opening 301.

According to the printers 100, 1000, 1200 of the embodiments according to the present invention, during work of installing the ribbon support axle 114 and/or the ribbon take-up axle 115 through the outer ribbon mounting opening 301, the axial ends in the axial direction that is through the outer ribbon mounting opening 301 can be guided to the first support hole 601 and the second support hole 604 by the first upper guide member 602 and the second upper guide member 605. As a result, the workability for mounting and removing the ink ribbon 302 through the outer ribbon mounting opening 301, which has a limited size, can be enhanced.

Further, the printers 100, 1000, 1200 of the embodiments according to the present invention are characterized in that the first upper guide member 602 has a shape that expands more on the outer ribbon mounting opening 301 side than on the first support hole 601 side. Further, the printers 100, 1000, 1200 of the embodiments according to the present invention are characterized in that the second upper guide member 605 has a shape expanded more than on the second support hole 604 side.

According to the printers 100, 1000, 1200 of the embodiments according to the present invention, the degrees of freedom of the positions of the axial ends of the ribbon support axle 114 and the ribbon take-up axle 115 in the axial direction, at a vicinity of the outer ribbon mounting opening 301 can be ensured. As a result, the workability for work of installing the ribbon support axle 114 and/or the ribbon take-up axle 115 in the cover member 202 through the outer ribbon mounting opening 301 can be enhanced.

Moreover, the printer 1200 of the embodiments according to the present invention is characterized in that the printer 1200 includes the damper member 1210 provided to the upper paper guide 108 and configured by the contact member 1301 that can be displaced along a direction away from the recording medium conveyance path 106, the damper member 1210 further configured by the biasing member 1302 that biases the contact member 1301 toward the recording medium conveyance path 106.

According to the printer 1200 of the embodiments according to the present invention, the damper member 1210 can be displaced interlinked to the opening and closing of the upper paper guide 108 thereby, enabling the ink ribbon 302 to be open to the outside through the inner ribbon mounting opening 702 without separately moving the damper member 1210.

As a result, the workability for mounting and removing the ink ribbon 302 can be enhanced and the load applied to the recording medium 1400 when pulled out is mitigated, enabling conveyance accuracy of the recording medium 1400 to be ensured.

Further, the printer 1200 of the embodiments according to the present invention is characterized in that the upper paper guide 108 is positioned between the ink ribbon 302 held by the ribbon support axle 114 and the ribbon take-up axle 115, and the recording medium 1400 in the recording medium conveyance path 106.

According to the printer 1200 of the embodiments according to the present invention, the damper member 1210, which requires no wiring, is provided to the upper paper guide 108 and not the lower paper guide 109, whereby a space that is wider than in a case where the damper member 1210 is provided in the housing 201 can be established in the housing 201.

As a result, other members such the sensor that requires wiring can be disposed in the space established in the housing 201 and therefore, in addition to preventing unintended marks on the recording medium 1400 by the recording medium 1400 contacting the ink ribbon 302, the occurrence of problems such as disconnection can be suppressed as compared to a case in which members that require wiring are provided in the cover member 202, which is movable with respect to the housing 201.

INDUSTRIAL APPLICABILITY

As described, the printer according to the present invention is useful for printers that perform a recording operation using an ink ribbon and is particularly suitable for printers in which the ink ribbon is replaceable.

EXPLANATIONS OF LETTERS OR NUMERALS

100, 1000, 1200 printer
114 ribbon support axle
115 ribbon take-up axle
201 housing
202 cover member
301 outer ribbon mounting opening (third opening)
302 ink ribbon
601 first support hole
602 first upper guide member
604 second support hole
605 second upper guide member
701 housing opening (first opening)
702 inner ribbon mounting opening (second opening)
710 hinge
1210 damper member
1301 contact member
1302 biasing member
1301*a* protrusion
1301*b* cantilever snap member

What is claimed is:

1. A printer comprising:

a housing that has a substantially box-shape and includes a first opening that opens facing in one direction;

a platen provided in the housing;

a cover that has a substantially box-shape and includes a second opening that opens facing in another direction opposite that of the first opening, the cover rotatably connected with the housing via a connection member and with the connection member as a center, the cover rotating to be positioned at a closed position making the second opening oppose the first opening and the cover rotating to be positioned at an open position making the second opening open;

a print head that is provided in the cover and opposes the platen in a state in which the cover is positioned at the closed position; and a pair of shaft members in the cover, closer to the second opening than the print head, the pair of shaft members provided enabling rotation thereof around an axis parallel a main scanning direction, the pair of shaft members holding an ink ribbon that is positioned between the platen and the print head in a state where the cover is positioned at the closed position, the ink ribbon being held so as to be freely fed and freely taken up, wherein the cover includes a third opening that at a side opposite that of the second opening, opens the print head and the pair of shaft members to an outside, wherein the third opening has along the main scanning direction, a dimension that is larger than a dimension of the pair of shaft members, along the main scanning direction.

2. The printer according to claim 1, wherein the pair of shaft members, in a plan view, overlaps the second opening and the third opening.

3. The printer according to claim 1, further comprising a conveyance guide member that guides a recording medium is provided enabling rotation of the conveyance guide member between a ribbon guide position whereby the ink ribbon is covered from a side toward the second opening and a ribbon open position whereby the ink ribbon is open to the outside through the second opening.

4. The printer according to claim 3, further comprising:

a holding unit that holds the recording medium enabling an end of the recording medium to be pulled out from an outer circumferential side of the recording medium that has an elongated shape and is wound in a roll; and a damper member that is configured by a contact member that is provided to the conveyance guide member and displaceable along a direction away from a conveyance path that conveys between the platen and the print head, the recording medium held by the holding unit, the damper member further configured by a biasing member that biases the contact member toward the conveyance path.

5. The printer according to claim 4, wherein the conveyance guide member is positioned between the ink ribbon and the recording medium in the conveyance path.

6. The printer according to claim 1, wherein the third opening is provided in the cover, spanning two continuous faces.

7. The printer according to claim 6, wherein the guide member has a shape that expands more on a side toward the third opening than on a side toward the support unit.

8. The printer according to claim 1, further comprising a guide member from the third opening to a support unit that supports each shaft member of the pair of shaft members.

* * * * *